US009255729B2

(12) United States Patent
Rindlisbach et al.

(10) Patent No.: US 9,255,729 B2
(45) Date of Patent: Feb. 9, 2016

(54) APPARATUS AND METHOD FOR ACCESSING REFRIGERATED ITEMS

(71) Applicants: Phillip Rindlisbach, Riverton, UT (US); Nicholas James Gregory, Provo, UT (US)

(72) Inventors: Phillip Rindlisbach, Riverton, UT (US); Nicholas James Gregory, Provo, UT (US)

( * ) Notice: Subject to any disclaimer, the term of this patent is extended or adjusted under 35 U.S.C. 154(b) by 0 days.

(21) Appl. No.: 14/215,593

(22) Filed: Mar. 17, 2014

(65) Prior Publication Data

US 2014/0300266 A1 Oct. 9, 2014

Related U.S. Application Data

(60) Provisional application No. 61/800,840, filed on Mar. 15, 2013.

(51) Int. Cl.
*F25D 23/00* (2006.01)
*F25D 25/02* (2006.01)

(52) U.S. Cl.
CPC ..... *F25D 25/027* (2013.01)

(58) Field of Classification Search
CPC . F25D 25/02; F25D 25/027; F25D 2325/021; F25D 2700/08
USPC ..... 312/408, 116
See application file for complete search history.

(56) References Cited

U.S. PATENT DOCUMENTS 2,157,754 A 10/1935 Gould
4,123,130 A * 10/1978 Locke ..... 312/285
4,191,437 A * 3/1980 Funke ..... 312/305
5,056,332 A * 10/1991 Tajima et al. ..... 62/252
5,577,823 A * 11/1996 Maglinger ..... 312/404
5,664,435 A * 9/1997 Bassuk ..... 62/381
6,309,034 B1 * 10/2001 Credle et al. ..... 312/116
6,883,887 B1 * 4/2005 Mogensen ..... 312/408
7,086,198 B2 * 8/2006 Hayden ..... 47/41.01
8,925,346 B2 * 1/2015 Natarajan et al. ..... 62/443

(Continued)

FOREIGN PATENT DOCUMENTS

EP 2457474 5/2012
WO 2010143973 12/2012

OTHER PUBLICATIONS

Ellison, D. and Mollendorf, J.C. Turn-Ease Motorized Refrigerator Lazy Susan, NSF 2005 Engineering Senior Design Projects to Aid Persons with Disabilities ,pp. 148-149, Creative Learning Press, Inc. 2005.

(Continued)

*Primary Examiner* — Daniel Rohrhoff
(74) *Attorney, Agent, or Firm* — Ongs Law Firm, PLLC; Jacob C. Ong

(57) ABSTRACT

A rotatable shelf for use in a refrigerator that may include a support bracket configured to support a turntable but is not required. A bearing ring may be disposed between the support bracket and the turntable, wherein the bearing ring is configured to facilitate the rotation of the turntable relative to the support bracket. The support bracket may further be configured to be installed into an interior space of a refrigerator such that the rotatable shelf assembly is oriented in a substantially horizontal direction. A user may then place items onto the turntable and manually or automatically rotate the turntable to access the items. Sensors may be configured to receive user input.

20 Claims, 24 Drawing Sheets

(56) References Cited

U.S. PATENT DOCUMENTS

| | | | | |
|---|---|---|---|---|
| 2004/0177641 | A1* | 9/2004 | Kim | 62/441 |
| 2006/0152123 | A1* | 7/2006 | Collins et al. | 312/405.1 |
| 2008/0053119 | A1* | 3/2008 | Doberstein et al. | 62/157 |
| 2008/0217266 | A1* | 9/2008 | Doyal | 211/1.52 |
| 2010/0314976 | A1* | 12/2010 | Gardner et al. | 312/116 |
| 2013/0186124 | A1* | 7/2013 | Wiklinski et al. | 62/264 |
| 2014/0132128 | A1* | 5/2014 | Simon | 312/116 |

OTHER PUBLICATIONS

Fuxin Industries, Inc., Browsing Gallery: Furniture Accessories, http://fuxin-yen.com/, http://fuxin-yen.com/tiki-browse_gallery.php?galleryId=8&offset=120&sort_mode=created_desc, http://fuxin-yen.com/tiki-browse_image.php?galleryId=8&sort_mode=created_desc&desp=27&offset=120&imageId=575, last accessed May 20, 2014.

* cited by examiner

APPARATUS AND METHOD FOR ACCESSING REFRIGERATED ITEMS

CROSS-REFERENCE TO RELATED APPLICATIONS

The present nonprovisional application claims the benefit of Provisional U.S. Patent Application Ser. No. 61/800,400 filed on Mar. 15, 2013; Application Ser. No. 61/800,400 is hereby incorporated by reference.

BACKGROUND OF THE INVENTION

1. The Field of the Invention

The present invention relates generally to shelving and storage space suitable for use in refrigerators. More specifically, some embodiments of the invention relate to refrigeration shelving and storage space that may be rotatable, removable, easily installable, or cleanable. Some embodiments may also include structures for supporting such shelving and storage space and may provide more convenient access to items stored thereon or improved temperature distribution.

2. Background

Traditional shelving used in conventional refrigerators is static, with such shelving and storage space generally shaped into squares or rectangles designed to follow the outer dimensions of the refrigerator. This configuration of square or rectangular fixed shelving may appear to maximize storage space within the refrigerator.

Traditional refrigerators include a refrigeration compartment located at the front of the refrigerator and accessible through a door. They also include another space, separate from the refrigeration space, which contains the mechanical components necessary to generate the refrigerated air that maintains the required cool temperature in the refrigeration compartment. This space for the mechanical components is typically rectangular and occupies most of the rear portion of the refrigerator. In some refrigerators, this space may occupy the entire rear three to four inches of the refrigerator. The refrigeration space is also typically rectangular or square, and generally contains rectangular or square shelving and/or drawers dispersed throughout. This arrangement has typically been viewed as maximizing the internal storage space of the refrigerator.

This fixed storage arrangement may, however, lead to several undesirable effects. Items stored on fixed shelving are continuously pushed towards the rear of the refrigerator as additional items are added to the shelf before the original items are removed or used. Thus, over time, the items first placed onto the shelf become inaccessible because the items placed in front of them block access. Further, not only may it be difficult to access the items that have been pushed towards the rear of the shelf, it may also be difficult to even visually see those items. The items pushed towards the rear of the shelf may become visually blocked by both the items placed in front of them and by the other shelves or structures of the refrigerator itself, especially when viewed from an angle above the shelf, as may be typical of a user standing in front of a refrigerator.

Often, this lack of visibility and/or accessibility leads to such items being forgotten about by the user. Because many items stored in a refrigerator are food items with limited shelf life, forgotten items have a greatly increased risk of expiring before being used.

Additionally, food items that have been pushed to the rear of a static shelf, and that have consequently become hard to see and access, and that have expired, may create undesirable odors within the refrigerator. The expired food items may also create increased health risks associated with bacterial growth.

Another disadvantage to the conventional static shelving used in traditional refrigerators results from the imperfect temperature distribution within refrigerators. Traditional refrigerators likely include fixed cooling vents located at the rear of the refrigerator. The fixed nature of these vents causes an unequal temperature distribution within the refrigerator, where temperatures are likely colder closer to the vents and warmer farther from the vents.

Thus, in a traditional refrigerator containing static shelving, items placed closer to the vents are stored at a colder temperature than items stored farther from the vents. The foods stored at the colder temperatures are more likely to freeze, which may be undesirable, while the foods stored at the warmer temperatures may be more likely to spoil, which also may be undesirable.

The static nature of traditional refrigerator shelving exacerbates this problem because the stored items, once placed on the shelf are subject to whichever temperature zone they happen to occupy, either warmer or colder. Further, the shelving itself creates a static obstacle that obstructs the cold air coming into the refrigeration compartments from the vents from easily mixing with the air already inside the refrigeration space, leading to increased variance in temperature throughout the refrigerator.

SUMMARY

The various implementations of the present invention are provided as a device for storing food in a refrigerator on a rotatable shelf, for mitigating the negative effects of the unequal temperature distribution that exists within refrigerators, or for increasing access and visibility of items stored on refrigerator shelves. In one embodiment, this invention may comprise a rotatable shelf assembly for a refrigerator. The rotatable shelf assembly may include a support bracket having a flat upper surface and an outer edge portion configured to physically engage an inner wall of a refrigerator and orient the support bracket in a substantially horizontally direction within the refrigerator. A bearing ring having an upper and lower surface and at least three bearings disposed therein, wherein the bearings are configured to extend beyond the upper and lower surface, and wherein the bearings are configured to roll on the flat upper surface of the support bracket may also be included. The rotatable shelf assembly may further comprise a turntable in the shape of a flat disk with an upper and lower surface, configured in size and shape such that the at least three bearings of the bearing ring roll on the lower surface of the turntable, thus supporting the turntable. In another embodiment, the invention may comprise a refrigerator with at least one rotatable shelf disposed within an interior space of the refrigerator, and at least one electric motor mechanically coupled to the at least one rotatable shelf and configured to cause the rotation of the at least one rotatable shelf in either a clockwise or counter-clockwise direction, or both. Embodiments of the invention may additionally include sensors disposed within the interior space of the refrigerator and connected to control circuitry that may be configured to control the rotation of rotatable shelves in response to user hand motions or the presence of a user hand.

In other embodiments, the invention may include shelving attached to an inner surface of a refrigerator door and configured for use in a refrigerator that further comprises substantially circular shelving. The door shelving may extend from the inner surface of a door, wherein the distal edge portion of the door shelving may be configured to extend into an interior space of a refrigeration unit and substantially follow a radius of a substantially circular shelf disposed within the interior of the refrigerator.

In another embodiment, the invention may comprise a method for controlling rotation of a rotatable shelf for a refrigerator. The method may include providing a first sensor configured to sense the motion or presence of a user's hand of other object, providing a second sensor configured to sense the motion or presence of a user's hand or other object, providing a control module connected to an input of both the first sensor and the second sensor and further connected to an electric motor that is mechanically coupled to a rotatable shelf, configuring the control module to cause the electric motor to rotate the rotatable shelf in a clockwise direction when a user's hand is sensed passing the first sensor before the user's hand is sensed passing the second sensor; and configuring the control module to cause the electric motor to rotate the rotatable shelf in a direction, such as a counter-clockwise direction, clockwise direction, horizontal direction, forward direction, backward direction, or vertical direction, when a user's hand or object is sensed passing the second sensor before the user's hand or object is sensed passing the first sensor.

These and other objects and features of the present invention will become more fully apparent from the following description and appended claims, or may be learned by the practice of the invention as set forth hereinafter.

BRIEF DESCRIPTION OF THE DRAWINGS

The preferred embodiments of the present invention will be described in conjunction with the appended drawings. Like designations denote like elements, and.

DETAILED DESCRIPTION

It will be readily understood that the components of the present invention, as generally described with reference to the drawings herein, could be implemented in a wide variety of different configurations. Thus, the following more detailed description of the embodiments of the system and method of the present invention, is not intended to limit the scope of the invention, but is merely representative of various embodiments of the invention. Unless explicitly stated, the use of "or" means and/or, that is, this the non-exclusive meaning of or.

Embodiments of the present invention may also be applicable to the medical field wherein vaccinations and other biological medications or chemicals need constant cold temperatures to have a longer life. Warm and very cold areas are undesired for chemicals that need constant temperatures.

Figure 1A:
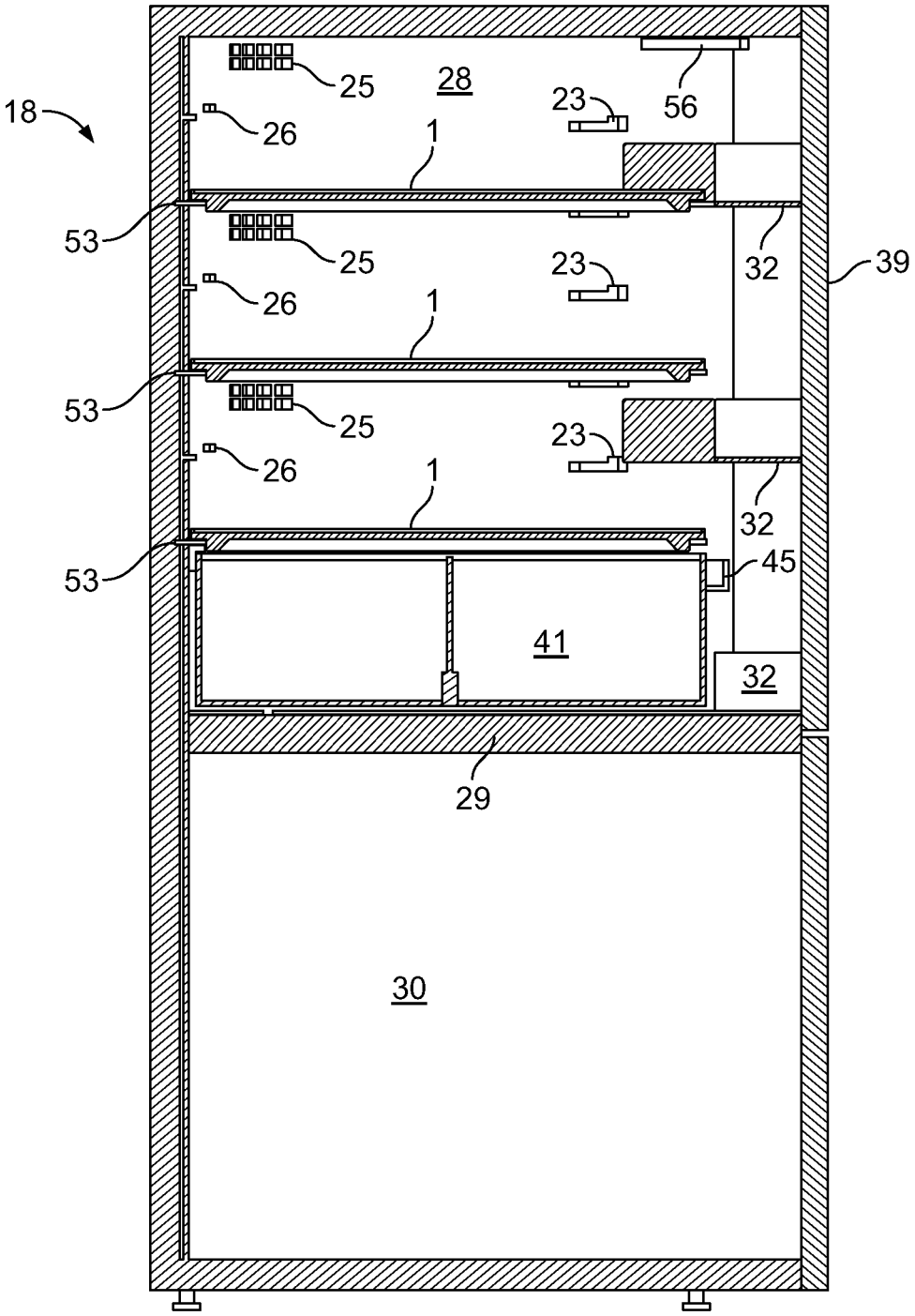
FIG. 1A is a cross-sectional view, from a side perspective, of a refrigerator such as the one shown in FIG. 10B, with more than one rotatable shelf assembly installed therein.

Referring now to FIG. 1A, a cross-sectional view, from a side perspective, of a refrigerator 18 configured for use with some embodiments of the invention is shown. Refrigerator 18 may comprise a refrigeration compartment 28 and a freezer compartment 30 separated by divider 29. Refrigeration compartment 28 or freezer compartment 30 may be of various sizes and locations; in some embodiments freezer compartment 30 is located above, to the side of, or below refrigeration compartment 28. As used herein, "refrigerator" includes a refrigerator without a freezer, a freezer without a refrigeration compartment, or refrigerator compartment. Refrigeration compartment 28 or freezer compartment 30 may include one or more rotatable shelf assembly 1. In some embodiments, refrigeration compartment 28 or freezer compartment 30 may also include one or more rotating drawer assembly 41. Rotatable shelf assembly 1 and rotating drawer assembly 41 will be discussed in greater detail below.

Refrigerator 18 may also include a refrigerator door 39, which may be configured to provide access to refrigeration compartment 28, freezer compartment 30, or both when door 39 is in an open position. When door 39 is in a closed position, as seen in FIGS. 1A and 10B it may be configured to seal at least one of the following selected from the group consisting of refrigeration compartment 28 and freezer compartment 30. Door 39 may also include at least one door shelf 32. In some embodiments, door shelf 32 is configured to extend within refrigeration compartment 28 and substantially fill the space between a substantially circular shelf, like a rotatable shelf assembly 1, and refrigerator door 39. Refrigerator 18 may also include, within refrigeration compartment 28 or freezer compartment 30, at least one vent 25, at least one bracket support 23, and at least one slit 26. The utility of these features, present in some embodiments of the invention, will be fully explained in greater detail below.

Figure 1B:
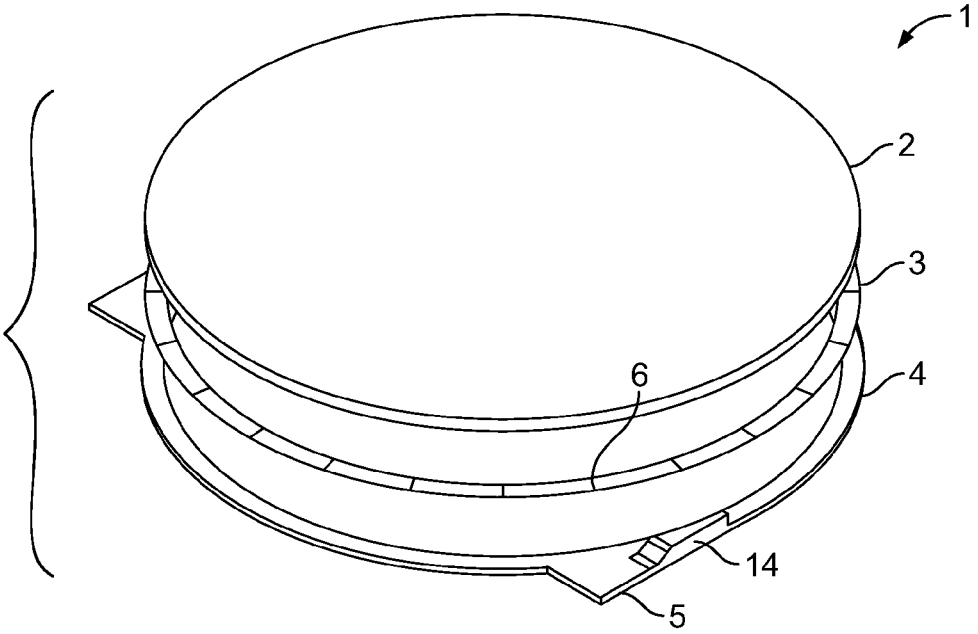
FIG. 1B is a diagram of an exploded view of an embodiment of a rotatable shelf assembly.

FIG. 1B presents an exploded view of an embodiment of rotatable shelf assembly 1. Some embodiments of rotatable shelf assembly 1 may comprise at least one turntable 2 and at least one support bracket 4. A bearing ring 3 may also be positioned between turntable 2 and support bracket 4. Bearing ring 3 may be configured to facilitate the rotation of turntable 2 relative to support bracket 4. In some embodiments, this rotation may be accomplished by the use of bearings 6 that are spaced along bearing ring 3. Bearings 6 may comprise substantially cylindrical roller pins, substantially spherical ball bearings, or external wheels in various embodiments of the invention. Bearing ring 3 with at least one bearing 6 may be configured such that the at least one bearing 6 rolls along a top surface of the support bracket 4 and/or along a bottom surface of a turntable 2, thus facilitating the rotation of turntable 2.

In other embodiments, rotatable shelf assembly 1 may comprise only turntable 2 and bearing ring 3. In this embodiment, bearing ring 3 is configured to support turntable 2 and to facilitate rotation of turntable 2 relative to an object upon which bearing ring 3 rests.

In some embodiments, support bracket 4 may be configured to support bearing ring 3 and turntable 2. This may accomplished by the use of one or more flanges 5 disposed on outer edge portions of support bracket 4, as seen in FIGS. 1B, 4A, 4C, and 4D. One or more flanges 5 may be configured to rest in slotted or recessed bracket supports 230 disposed in an interior wall 16, 161 of refrigerator 18. When one or more flanges 5 are inserted into or rested upon bracket supports 23, 230, the interior walls of refrigerator 18 may provide support for support bracket 4. Support bracket 4 may then provide support for bearing ring 3, which, in turn, may provide support for turntable 2. Turntable 2 may then provide support for any items that are to be stored within refrigerator 18.

Figure 1C:
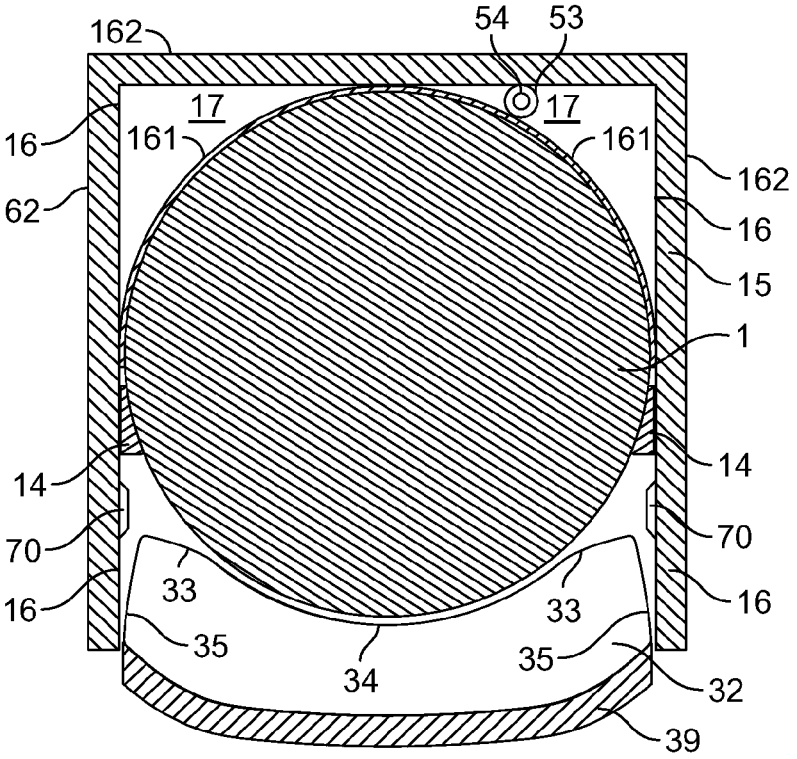
FIG. 1C is a diagram of a cross-sectional view with a cross section taken from a refrigerator such as the one shown in FIG. 10B, from a top perspective, of an embodiment of a refrigerator with a rotatable shelf assembly installed therein.

As shown in FIG. 1C, some embodiments of the invention may be configured to efficiently utilize the interior space of a refrigerator 18. An interior wall 16 of refrigerator 18 may be shaped so that the rear portion of interior wall 161 follows a substantially constant radius that is configured to touch an outer surface of support bracket 4. Side portions of interior wall 16 may be substantially straight. The space between the interior walls 16, 161 of refrigerator 18 and outer walls 162 may be filled with insulation 15 to insulate the temperature of air within the refrigerator from the temperature of air outside of the refrigerator. The rear portion of interior wall 161 may curve at a radius to create at least one cavity 17 in the rear corners of refrigerator 18 between the rear portion of interior wall 161 and outer walls 162. Mechanical components and/or ductwork may be configured within the at least one cavity 17 to provide refrigerated air to refrigeration compartment 29.

In some embodiments, the size of rotatable shelf assembly 1 may be substantially increased by configuring the outer diameter of rotatable shelf assembly 1 to be approximately equal to the distance between side portions of interior walls 16. The radius of rear portion of interior wall 161 may further be configured to approximately equal one-half the distance between side portions of interior walls 16.

Figure 2A:
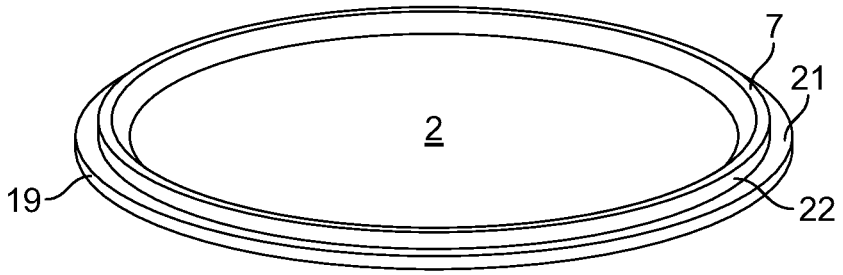
FIG. 2A is a bottom perspective view of an embodiment of a turntable configured for use with some embodiments of a rotatable shelf assembly.
Figure 2B:
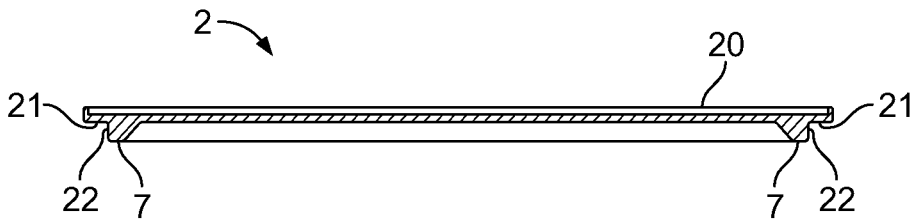
FIG. 2B is a cross-sectional view of an embodiment of a turntable, the cross-section being created by a vertical plane as seen in FIG. 2C and viewed from an side view.
Figure 2C:
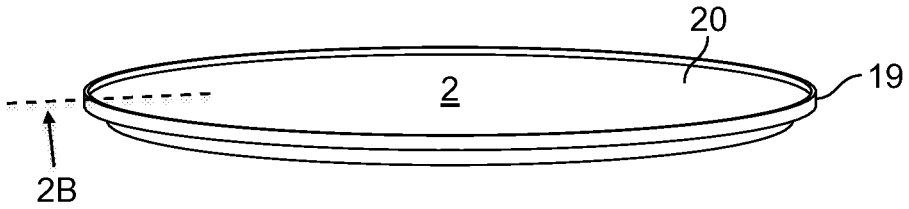
FIG. 2C is a top perspective view of an embodiment of a turntable configured for use with some embodiments of a rotatable shelf assembly.

Referring now to FIG. 2A-2C, an embodiment of turntable 2 is shown. In some embodiments turntable 2 may be a flat disk comprising an outer radius 19 and a flat surface 20. In other embodiments, flat surface 20 may be slightly concave. Items to be stored on rotatable shelf assembly 1 may be placed on flat surface 20. In other embodiments, turntable 2 may be formed as a hexagonal, octagonal, or any polygonal shape.

In some embodiments, turntable 2 is made from tempered glass, plastic, or any other material suitable for use inside refrigerator 18 and capable of supporting the weight of items stored on turntable 2. In some embodiments, the thickness of turntable 2 may be less than one inch; however, other thicknesses may be utilized in certain other embodiments. Turntable 2 may be manufactured from materials and with a particular thickness such that the turntable can support the weight of the items placed thereon. Turntable 2 may be manufactured through tempered glass casting, plastic injection molding, laser sintering, casting, sheet metal punching, milling, or other appropriate processes. Turntable 2 may also be coated with an anti-corrosive finish. In some embodiments turntable is formed with a hole on its lower surface and a pin or some other object which may be used as a center pivot may be inserted into the hole.

In some embodiments, outer radius 19 of turntable 2 may be configured to be slightly less than the radius of the rear portion of interior wall 161 of refrigerator 18. Such an outer radius 19 may increase the surface area of flat surface 20, increasing the available storage space, while still allowing turntable 2 to rotate freely and with a clearance with respect to interior walls 16, 161 of refrigerator 18. For purposes of this disclosure, clearance is defined as a relative positioning of two objects such that a first object can move relative to a second object without touching the second object.

FIG. 2B shows a cross-sectional view of an embodiment of turntable 2 that is shown in FIG. 2A and 2B. In some embodiments, turntable 2 includes a substantially circular lower support flange 7 that extends from the bottom of turntable 2. Turntable 2 thus may include a lower horizontal support surface 21 and a lower vertical support surface 22. In some embodiments, lower support flange 7, lower horizontal support surface 21, and lower vertical surface 22 are configured to ensure that turntable 2 remains substantially centered relative to bearing ring 3 and support bracket 4 when assembled. In some embodiments lower support flange 7 may be manufactured separately and then attached, either mechanically or chemically, to the bottom of turntable 2. In other embodiments, the lower support flange is manufactured as an integral, continuous part of the turntable 2.

Turntable 2 may also include, in some embodiments, a lip 19 that extends upward from the outer edge portion of flat surface 20. Lip 19 may be configured to help contain any spills that occur on flat surface 20. Lips 19 may also be configured to prevent items from falling off by centrifugal or centripetal forces acting on the items during turntable rotation. In some embodiments, lip 19 may also be comprise a high friction, grip-inducing material, or may be formed from small bumps or ridges.

In some embodiments of the invention, turntable 2 may be configured to be easily cleanable. Further, turntable 2 may be manufactured from a material that is resistant to stains and/or may be manufactured by filleting all sharp corners of turntable 2 to help prevent food or other items from becoming wedged therein.

Referring now to FIGS. 3A-3G, 12A-12C, and 14A-14C, various embodiments of bearing ring 3 are shown. As noted above, bearing ring 3 may be configured to facilitate the rotation of turntable 2 relative to support bracket 4 or relative to any object upon which turntable 2 and bearing ring 3 are placed. In some embodiments, bearing ring 3 may be configured to be insertable between turntable 2 and support bracket 4 and may further comprise bearings 6 to facilitate the rotation of turntable 2. The shape of bearings 6, 8 may vary in different embodiments of the invention and it should be understood that any suitable shape may be used, including, but not limited to, substantially cylindrical roller pins, substantially spherical ball bearings, or external wheels.

In some embodiments of the invention, the outermost radius of bearing ring 3 is slightly less than the radius of rear portion of interior wall 161 of refrigerator 18, allowing for clearance between interior walls 16, 161 and bearing ring 3. This configuration may allow bearing ring 3 to rotate freely without binding or bumping against interior walls 16, 161 of refrigerator 18.

Figure 3A:
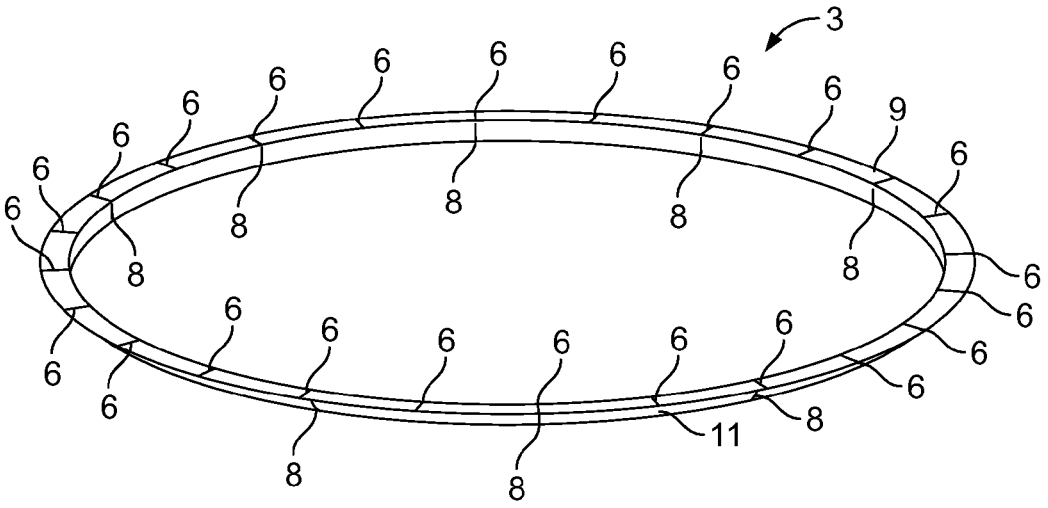
FIG. 3A is an embodiment of a bearing ring for use in some embodiments of a rotatable shelf assembly, wherein the bearing ring comprises a horizontal flange and a vertical flange.
Figure 3B:
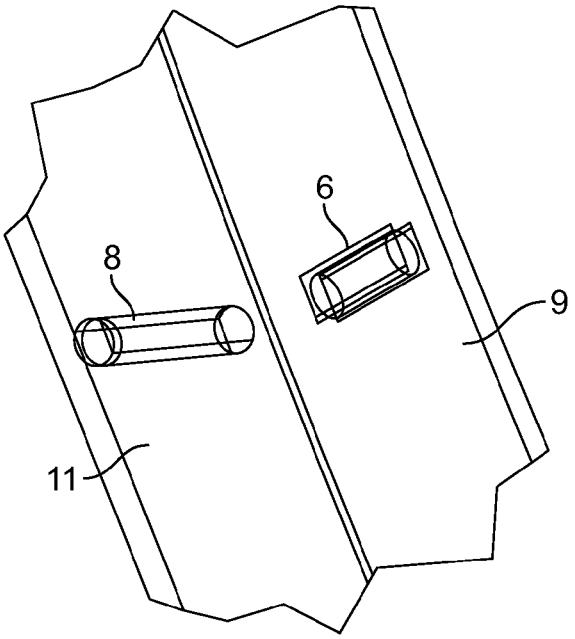
FIG. 3B is a diagram of a detailed view of the placement and configuration of bearings in the embodiment of the bearing ring shown in FIG. 3A.
Figure 3C:
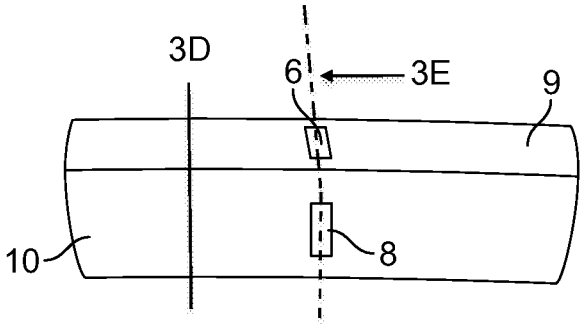
FIG. 3C is a diagram of a detailed view of two bearings shown in the top center portion of the bearing ring shown in FIG. 3A.
Figure 3D:
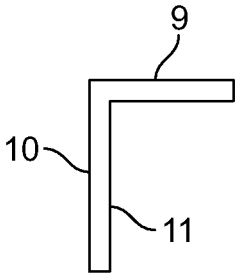
FIG. 3D is a cross-sectional view of an embodiment of a bearing ring taken at a location that does not include bearings, the plane on which the cross-section is taken can be seen in FIG. 3C.

One embodiment of bearing ring 3 is depicted in FIGS. 3A-3G. In this embodiment bearing ring 3 comprises an annular ring with a generally L-shaped cross-section, as seen in FIG. 3D. The L-shaped cross-section may be formed from a horizontal flange 9 and a vertical flange 10. Horizontal flange 9 and vertical flange 10 may be manufactured separately and then attached to each other, such as by a mechanical process or chemical process, or they may be manufactured as one integral part. In some embodiments bearings may be disposed in both horizontal flange 9 and vertical flange 10; thus, there may be both horizontal bearings 6 and vertical bearings 9. Horizontal bearings 6 may be configured to roll along a lower horizontal support surface 21 of turntable 2, and thus may support turntable 2 and may allow it to rotate freely. Horizontal bearings 6 may also be configured to roll along a top surface 12 of support bracket 4. In some embodiments, bearing ring 3 comprises at least three equally spaced horizontal bearings 6. In some embodiments, bearing ring 3 may also comprise at least three vertical bearings 8. Vertical bearings 8 may be configured to roll along a lower vertical support surface 22 of turntable 2, which may thus facilitate that turntable 2 remain substantially centered relative to bearing ring 3 and support bracket 4. Vertical bearings 8 may be further configured to roll along inner surface 13 of support bracket 4, which may thus facilitate that bearing ring 3 remains substantially centered relative to support bracket 4. In some embodiments, turntable 2, bearing ring 3, and support bracket 4 may be configured to remain substantially concentric with each other.

FIG. 3B provides a detailed view of the placement of horizontal bearing 6 and vertical bearing 8 in a portion of the embodiment of bearing ring 3 depicted in FIG. 3A. In this embodiment, substantially cylindrical bearings 6, 8 are placed into substantially cylindrical recesses formed in horizontal flange 9 and vertical flange 10. The substantially cylindrical recesses may be sized to provide clearance between the body of bearing ring 3 and bearings 6, 8. In another embodiment, bearings 6, 8 may be substantially spherical, and slightly larger recesses may also be substantially spherically shaped so as to accommodate substantially spherical bearings 6, 8, while still allowing them to rotate substantially freely. Bearings 6, 8 may be inserted into bearing ring 3 by pressure. Bearings 6, 8 may also be inserted by bending bearing ring 3, thus further opening the recesses and allowing bearings 6, 8 to be inserted.

FIG. 3C illustrates a detailed top perspective view of bearings 6, 8 at the "11:00 position" relative to a clock located in a section of an embodiment of bearing ring 3 and depicted by FIG. 3A. Vertical bearing 8 is located in vertical flange 10, and horizontal bearing 6 is located in horizontal flange 9 of bearing ring 3. FIGS. 3F and 3G provide additional views of the portion of the embodiment of the bearing ring shown in FIG. 3C.

Figure 3E:
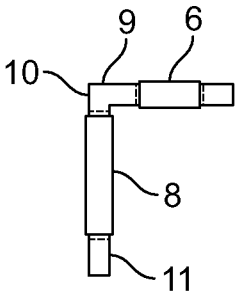
FIG. 3E is a cross-sectional view of an embodiment of a bearing ring taken at a location that includes the bearings, the plane on which the cross-section is taken can be seen in FIG. 3C.
Figure 3F:
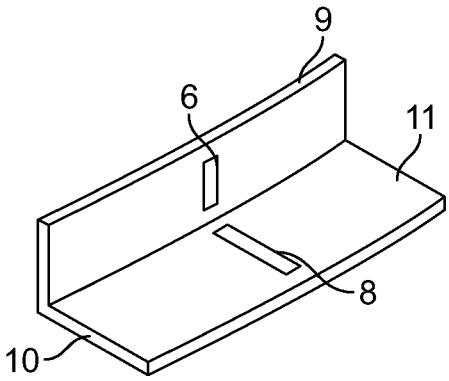
FIG. 3F depicts the detail view of FIG. 3C as seen from a bottom perspective view.
Figure 3G:
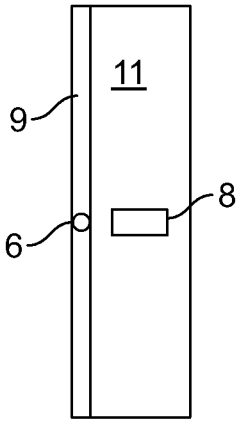
FIG. 3G depicts the detail view of FIG. 3C as seen from a bottom view.

FIGS. 3D and 3E illustrate cross-sectional views of one embodiment of a bearing ring 3 with horizontal flange 9, horizontal bearing 6, vertical flange 10, and vertical bearing 8. In some embodiments the outer diameter of horizontal bearing 6 and vertical bearing 8 is greater than the thickness of horizontal flange 9 and vertical flange 10. This arrangement may allow horizontal bearings 6 vertical and vertical bearings 8 to make contact with support surfaces on either side of the flanges 9, 10. Further, in some embodiments, the recesses that house bearings 6, 8 may be open from each side of flanges 9, 10.

The main body of bearing ring 3 may be made from polymer plastic, metal, vinyl, or any other appropriately material, such as a material that is strong and/or easily cleanable. In some embodiments the main body of bearing ring 3 may be manufactured through injection molding, laser sintering, or any other appropriate manufacturing process. Bearing ring 3 or bearings 6, 8 may also be coated with an anti-corrosive substance.

Bearings 6, 8 may be made from any material sufficient to support the weight of turntable 2 and items stored thereon; this may include metal, ceramic, or a hard plastic. Bearings 6, 8 may also be formed as either rollers, having a substantially cylindrical shape, balls, having a substantially spherical shape, or any other suitable shape. In some embodiments, bearings 6, 8 are inserted into the main body of bearing ring 3 though the application of pressure. The main body of bearing ring 3 may include cavities formed therein to receive bearings 6, 8. The cavities should be appropriately sized to contain bearings 6, 8, while still allowing them to rotate relatively freely.

In some embodiments, bearing ring 3 may include at least three horizontal bearings 6 spaced evenly around the horizontal flange 9 of bearing ring 3, and also may include at least three vertical bearings 8 spaced evenly around vertical flange 10 of bearing ring 3. However, it will be appreciated that more than three horizontal bearings 6 and more than three vertical bearings 8 may be utilized. In some embodiments, bearing ring 3 may include three, four, five, six, seven, eight, nine, ten, or more horizontal bearings 6 and three, four, five, six, seven, eight, nine, ten, or more vertical bearings 8. It is also contemplated the spacing of bearings 6, 8 need not be even in all embodiments.

Figure 14A:
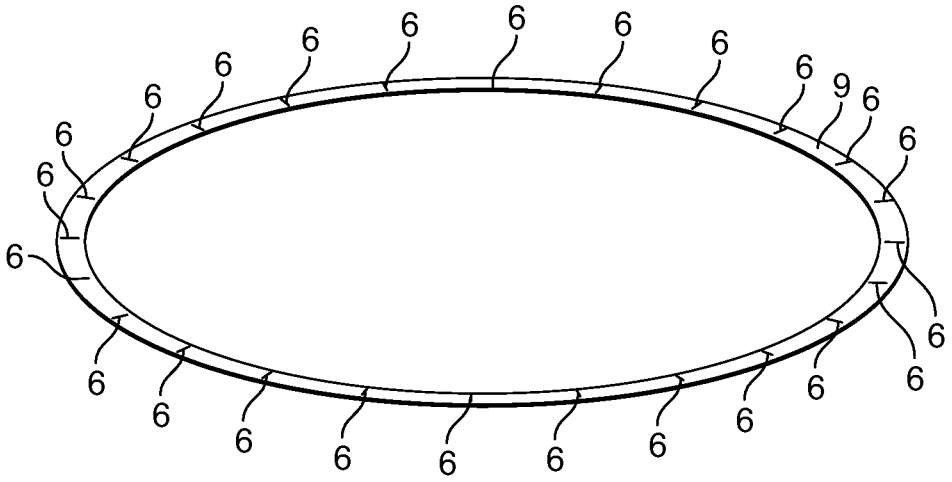
FIG. 14A is a top perspective view of an alternative embodiment of a bearing ring, wherein the bearing ring comprises a horizontal flange.
Figure 14B:
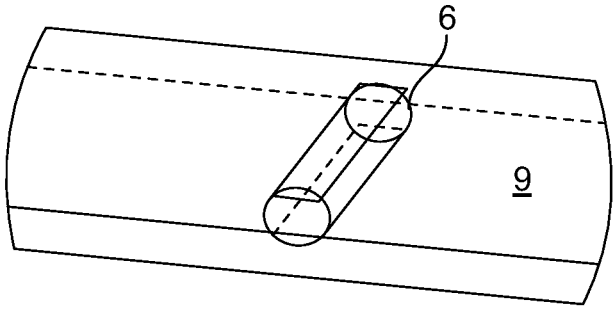
FIG. 14B is a top perspective view of a portion of the alternative embodiment of a bearing ring of FIG. 14A.
Figure 14C:
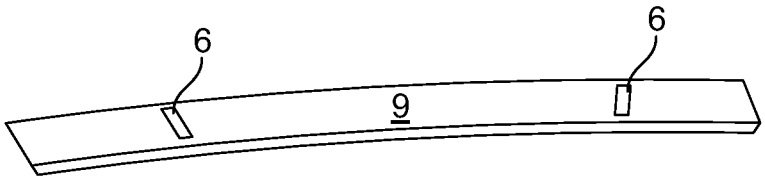
FIG. 14C is a top perspective view of a portion of an embodiment of the bearing ring depicted in FIG. 14A.

Another embodiment of a bearing ring 3 is depicted in FIGS. 14A-14C. In this embodiment bearing ring 3 comprises only a horizontal flange 9 and horizontal bearings 6. In some variation of this embodiment, bearing ring 3 may include at least three horizontal bearings 6 evenly spaced around the bearing ring 3. However, it is contemplated that bearing ring 3 may include more than three horizontal bearings 6 in some embodiments and that the spacing of horizontal bearings 6 need not be uniform in all cases. FIGS. 14B and 14C provide detailed views of a possible configurations of horizontal bearings 6 in some embodiments of bearing ring 3 that comprise only a horizontal support flange 9. As pictured in FIG. 14B, substantially cylindrical bearings 6 are placed into substantially cylindrical recesses formed in horizontal flange 9. The substantially cylindrical recesses may be sized to provide clearance between the body of bearing ring 3 and bearings 6. In another embodiment, bearings 6 may be substantially spherical, and slightly larger recesses may also be substantially spherically shaped so as to accommodate substantially spherical bearings 6, while still allowing them to rotate substantially freely. Bearings 6 may be inserted into bearing ring 3 by pressure. Bearings 6 may also be inserted by bending bearing ring 3, thus further opening the recesses and allowing bearings 6 to be inserted.

Figure 12A:
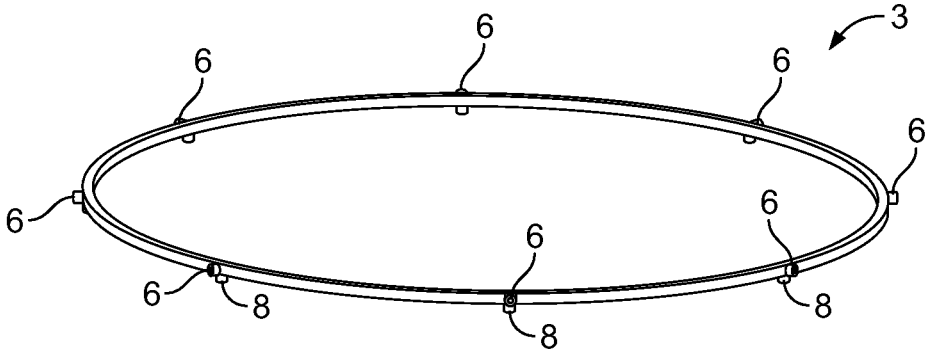
FIG. 12A is a diagram of an alternative embodiment of a bearing ring comprising external wheels.
Figure 12B:
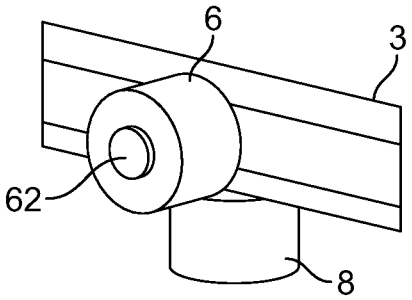
FIG. 12B is a detail perspective view of an embodiment of a section of a bearing ring comprising external wheels which depicts a horizontal wheel and vertical wheel.
Figure 12C:
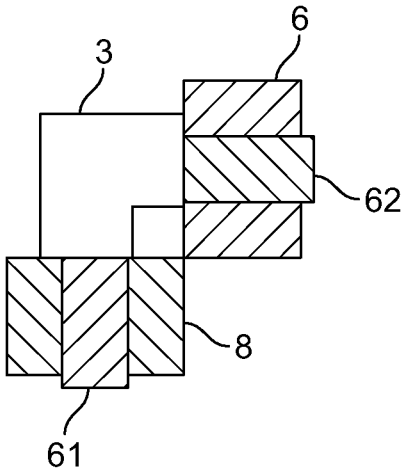
FIG. 12C is a cross-sectional view of an embodiment of a section of a bearing ring comprising external wheels, wherein the plane on which the cross-section is taken may be seen in FIG. 12A.

FIGS. 12A-12C illustrate an alternative embodiment of bearing ring 3, wherein bearings 6, 8 comprise external wheels mounted on axels 61, 62 that extend from bearing ring 3. In some embodiments, bearing ring 3 includes at least three horizontal axels 62 extending therefrom with horizontal wheels 6 mounted thereon. In other embodiments, bearing ring 3 may include at least three vertical axels 61 extending therefrom with vertical wheels 8 mounted thereon. Bearing ring 3 may comprise only horizontal axels 62 and horizontal wheels 6, only vertical axels 61 and vertical wheels 8, or both. FIG. 12B provides a detail perspective view of a horizontal wheel 6 mounted on a horizontal axis 62 and a vertical wheel 8 mounted on a vertical axis 61. FIG. 12C provides a cross-sectional view of a horizontal wheel 6 mounted on a horizontal axis 62 and a vertical wheel 8 mounted on a vertical axis 61.

Referring now to FIGS. 4A-4D, an embodiment of support bracket 4 is shown. In some embodiments, support bracket 4 comprises a generally flat annular ring whose outer radius may be substantially equal to the radius of rear portion of interior wall 161 of refrigerator 18, so as touch a rear portion of interior wall 161 of refrigerator 18 when inserted into refrigerator 18. The outer radius of support bracket 4 may also be configured to include a small clearance between the outer edge portion of support bracket 4 and a rear portion of interior wall 161.

The thickness of support bracket 4 may be configured to be sufficient to support the weight of all items that may be placed thereon, including bearing ring 3, turntable 2, and any items to be stored on the turntable 2. In some embodiments, the thickness of support bracket 4 may be less than one inch, less than one-half inch, or less than one-quarter inch. However, it is contemplated that other thicknesses may be used in various embodiments of the invention.

In some embodiments, support bracket 4 may be made from metal, polymer plastic, or any other material that can adequately support the weight of, and resist the internal moments and shear stresses created by, the items that may be stored thereon. This may include strong alloys, like aluminum or steel, and strong plastics, like polycarbonate or carbon fiber. Support bracket 4 may also, in some embodiments, be coated with a corrosion resistant substance. Support bracket 4 may further comprise a coating to resist wear where the bearings 6, 8 of bearing ring 3 contact support bracket 4. Additionally, support bracket 4 may be manufactured through plastic injection molding, laser sintering, casting, sheet metal punching, milling or other any other appropriate manufacturing process.

In some embodiments, support bracket 4 further comprises a flat surface 12 configured to support bearing ring 3 and turntable 2. Flat surface 12 may be configured such that horizontal bearings 6 of bearing ring 3 may roll thereon, allowing for rotation of a turntable 2 resting on bearing ring 3. Flat surface 12 may be coated with a substance to prevent wear.

Support bracket 4 may also include, in some embodiments, an inner surface 13. Inner surface 13 may be configured such that vertical bearings 8 of bearing ring 3 roll thereon. In some embodiments this may cause bearing ring 3 to remain substantially concentric with support bracket 4. Inner surface 13 may be coated with a substance to prevent wear.

Support bracket 4 may also include support flanges 5, configured to rest in slotted, recessed, or grooved bracket supports 230 formed in interior walls 16, 161 of refrigerator 18. Support flanges 5 may be configured to secure support bracket 4 into the refrigerator 18 in a substantially horizontal orientation. In some embodiments, flanges 5 are also configured so that it is possible for a user to install or remove support bracket 4 from refrigerator 18.

In some embodiments, support bracket 4 may include at least three support flanges 5 spaced around the outer edge portion of support bracket 4. However, it is contemplated that, in some embodiments, more than three support flanges 5 may be utilized to secure support bracket 4 into refrigerator 18. For example, it is to be understood that in some embodiments support bracket 4 may include two, three, four, five, six, or more support flanges 5.

In some embodiments support flanges 5 are configured to be received into slotted bracket supports 230 located in refrigerator 18, in a front portion of interior wall 16, and also into a slotted bracket support 230 located in the rear of the refrigerator 18 in a rear portion of interior wall 161. However, in other embodiments support flanges 5 may be configured to be received only into bracket supports 23, 230 located on the sides of refrigerator 18.

In another embodiment of support bracket 4, the support bracket may not necessarily include any flanges. Rather, the interior walls 16, 161 of refrigerator 18 may be configured with ledges, shelves, cantilever, or other form of protruding bracket support 23 which may be configured to provide support for support bracket 4 when rested thereon. In other embodiments, support bracket 4 may include at least one support flange 5 configured to be received by a recessed bracket support 230 in an inner wall 16 of refrigerator 18 and be otherwise supported by at least one protruding bracket support 23 formed or attached to inner wall 16 of refrigerator 18. Bracket supports 23, 230 will be described in more detail below.

Figure 4A:
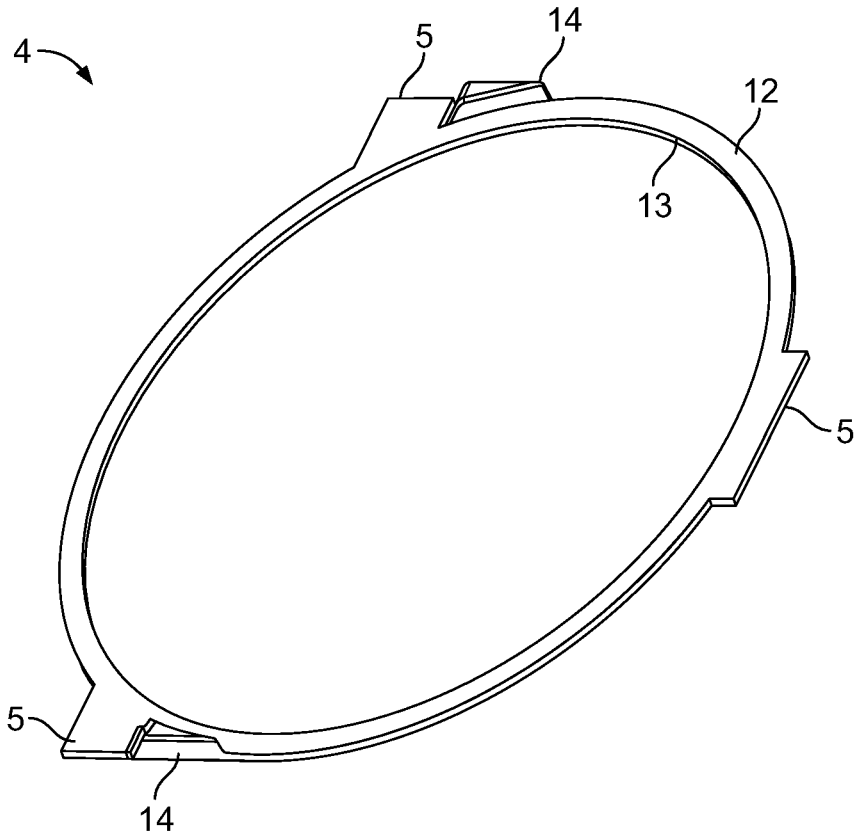
FIG. 4A is a diagram of an embodiment of a support bracket configured for use in a rotatable shelf assembly.
Figure 4B:
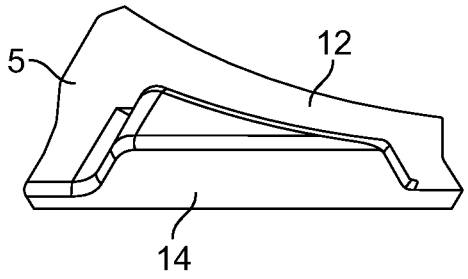
FIG. 4B is a diagram of an embodiment of a finger protection device that may be included on some embodiments of a support bracket.
Figure 4C:
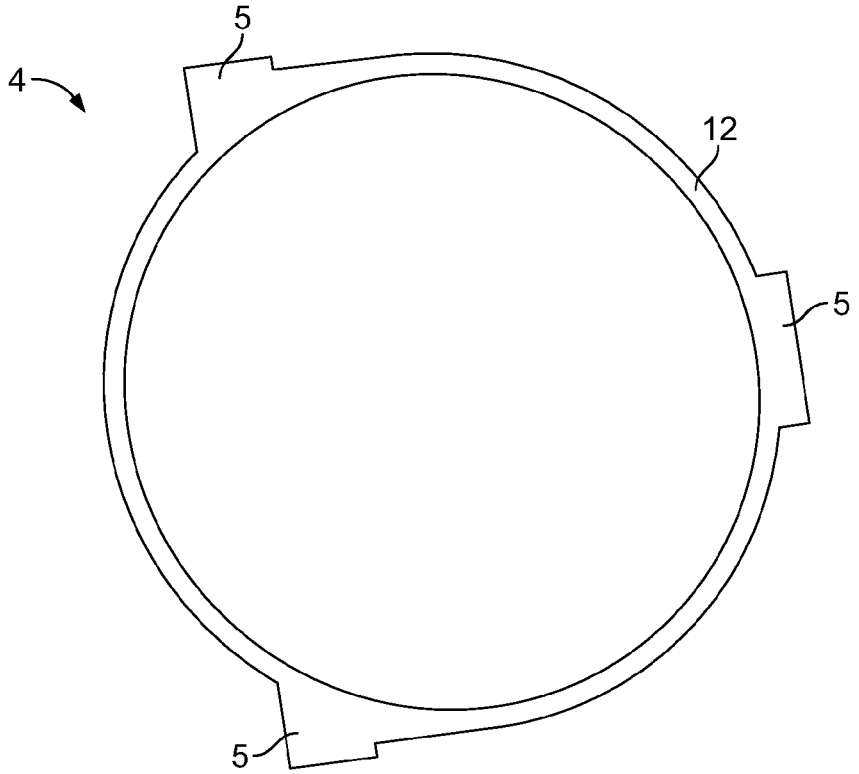
FIG. 4C is a diagram of a top plan view of an embodiment of a support bracket configured for use in a rotatable shelf assembly.
Figure 4D:
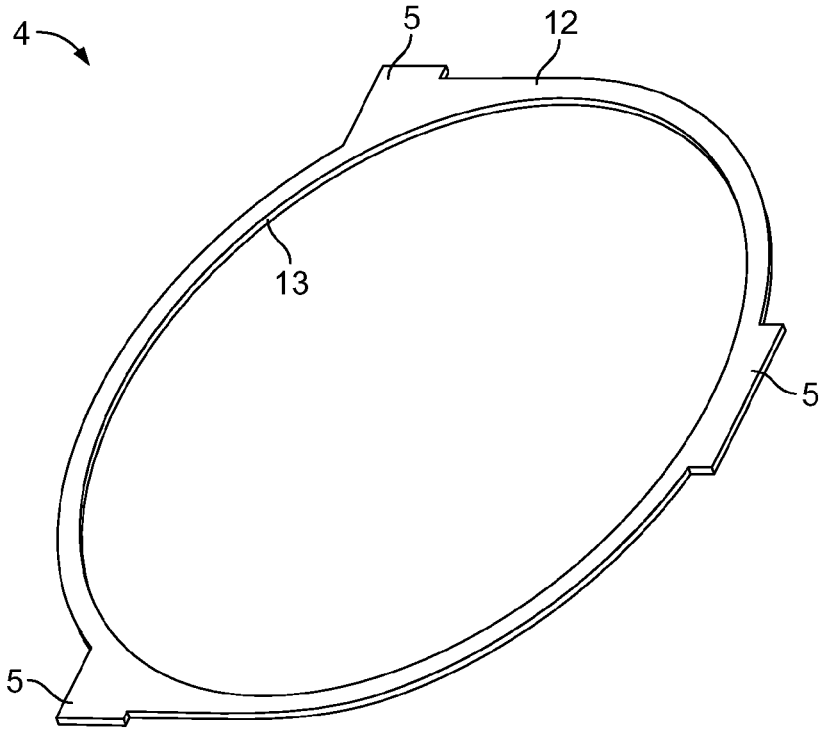
FIG. 4D is a perspective view of an embodiment of a support bracket configured for use in a rotatable shelf assembly.

FIG. 4B illustrates a feature that may be present in some embodiments of support bracket 4: at least one finger guard 14. In some embodiments finger guard 14 may be substantially wedge shaped and may be configured and oriented to prevent fingers or other items from being caught between turntable 2 and interior wall 16 of refrigerator 18 as turntable 2 rotates. In some embodiments, finger guard 14 may be formed separately and then attached mechanically or chemically to support bracket 5. In other embodiments, the finger guard 14 may be integrally formed with support bracket 4. In some embodiments finger guard 14 may be removable. Additionally, finger guard 14 may also be formed in or attached to interior wall 16, 161.

Figure 5A:
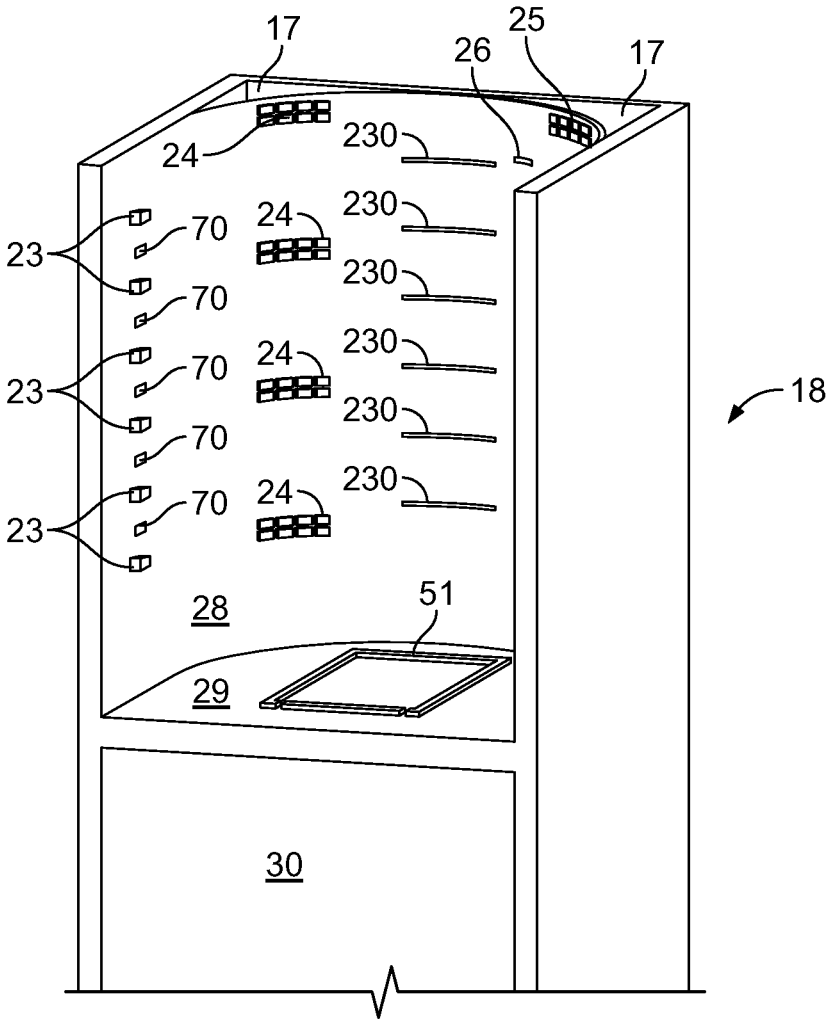
FIG. 5A is a diagram of a perspective view of an embodiment of a refrigerator body with door and roof removed configured for use with some embodiments of the invention.
Figure 5B:
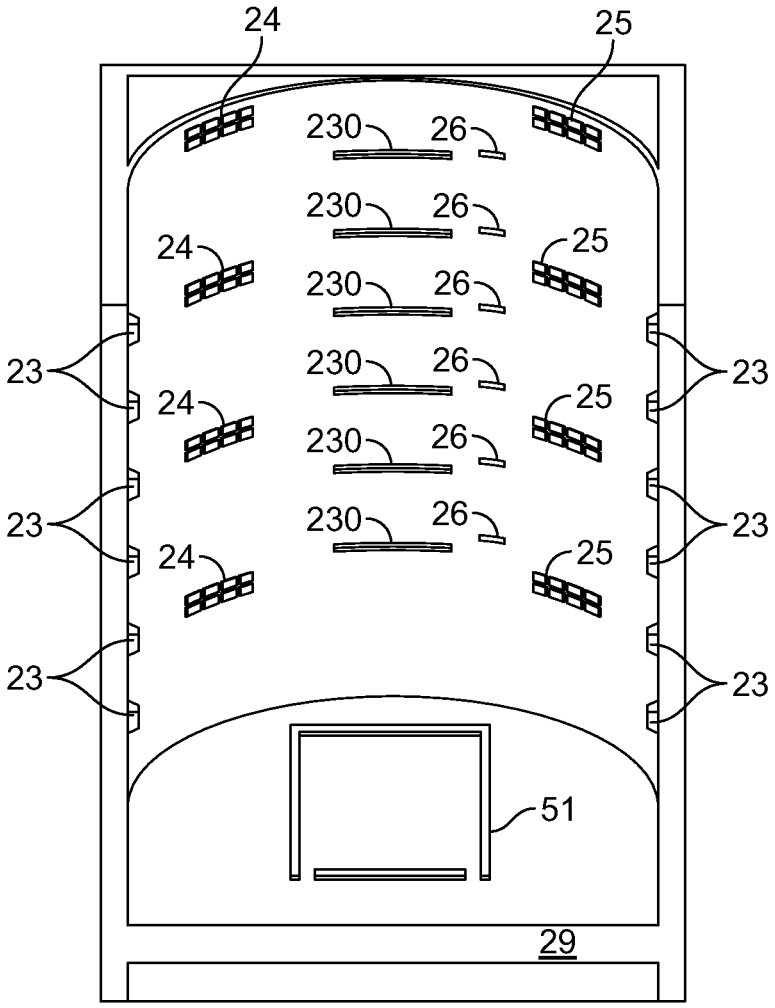
FIG. 5B is a diagram of an elevated front view of an embodiment of a body of a refrigerator compartment configured for use with some embodiments of the invention.

Referring now to FIGS. 5A and 5B, an embodiment of a body of a refrigerator 18 configured for use with some embodiments of the present invention is shown. In some embodiments, refrigerator 18 is divided into at least one refrigeration compartment 28 and at least one freezer compartment 30. The refrigeration compartment 28 may be separated from the freezer compartment 30 by at least one divider 29.

In some embodiments interior walls 16, 161 of refrigerator 18 may be configured for use with a rotatable shelf assembly 1. This may include side portions of interior walls 16 comprising substantially straight sections and a rear portion of interior wall 161 comprising a substantially curved section, as seen in FIG. 1C. The curved section may be of a radius selected to mate with the outer surface of support bracket 4 or turntable 1.

In some embodiments, both refrigeration compartment 28 and freezer compartment 30 are formed with interior walls 16, 161 as described above—i.e., with a curved rear section. However, in other embodiments, only one of the refrigeration compartment 28 or the freezer compartment 30 may have this curved inner wall 161.

In some embodiments, at least one cavity 17 is formed between the curved rear portion of interior wall 161 and the outer walls 162 of refrigerator 18, as seen in FIG. 1C, 5A, and 5B. The at least one cavity 17 is separated from refrigeration compartment 28 and freezer compartment 30 by rear portion of interior wall 161, and may be configured to accommodate mechanical components and ductwork such that refrigerated air is supplied to both refrigeration compartment 28 and freezer compartment 30. Outer walls 162 may also be lined with insulation 15 to efficiently maintain refrigeration compartment 28 and/or freezer compartment 30 at their desired temperatures.

In some embodiments of the invention, interior walls 16, 161 may be configured to include various bracket supports 23, 230 that are configured to receive and support at least one support bracket 4. Bracket supports 23, 230 may be spaced at equal or non-equal intervals vertically and horizontally along interior walls 16, 161 so that at least one rotatable shelf assembly 1 may be installed into refrigerator 18 at a plurality of different prefigured locations, selectable by the user.

FIGS. 5A and 5B present one non-limiting example of a potential vertical spacing of bracket supports 23, 230 in one embodiment of the invention. As seen in those figures, six rows of bracket supports 23, 230 are spaced evenly and vertically along interior walls 16, 161. It will be appreciated, however, that more or fewer bracket supports 23, 230 may be spaced vertically along interior walls 16, 161. For example, in some embodiments, one, two, three, four, five, six, or more rows of bracket supports 23, 230 may be spaced vertically along interior walls 16, 161, thus providing one, two, three, four, five, six, or more possible locations at which a rotatable shelf assembly 1 or other fixed shelf assembly may be installed. Further, in some embodiments, the vertical spacing of support brackets need not be evenly spaced.

It should also be appreciated that in some embodiments, a rotatable shelf assembly 1 need not be installed into every vertically spaced row of bracket supports 23, 230; however, in other embodiments, a rotatable shelf assembly 1 may be installed into every row of bracket supports 23, 230. Additionally, in some embodiments, both rotatable shelf assembly 1 and traditional static shelving may be installed into or onto bracket supports 23, 230.

Bracket supports 23, 230 may also be spaced at equal or non-equal intervals horizontally along interior walls 16, 161 to provide support for support bracket 4 at multiple locations along an outer edge portion of support bracket 4. This configuration may provide additional support to support bracket 4.

One non-limiting example of the horizontal spacing of bracket supports 23, 230 can be seen in FIGS. 5A and 5B. In the embodiment pictured in FIG. 5B, three bracket supports 23 are spaced horizontally along interior walls 16, 161 such that a first bracket support 23 is located on the right section of the right interior wall 16, a second bracket support 230 is on the curved rear curved portion of interior wall 161, and third bracket support 23 is on the left section of interior wall 16. Thus, in this embodiment, support bracket 4 would be supported at three points along interior walls 16, 161.

It should be understood however, that other embodiments may include more or fewer bracket supports 23, 230 spaced in the horizontal direction. For example in some embodiments, the interior walls 16, 161 may be configured to include two, three, four, five, or more bracket supports 23, 230 spaced horizontally along interior walls 16, 161. Further, in some embodiments, bracket supports 23, 230 may not be spaced evenly along interior walls 16, 161.

In some embodiments, a single bracket support 23, 230 may be used to support a support bracket 4. This may be achieved by configuring a single shelf or groove that runs along interior walls 16, 161 that may be used to support a support bracket 4.

It is contemplated that various forms of bracket supports 23, 230 may be configured for use with various embodiments of the invention. A variety of embodiments of bracket supports is shown in FIGS. 5C-5H. In some embodiments, bracket support 23 may protrude out from interior walls 16, 161. This protrusion may be a small shelf, knob, or other form of cantilever support.

Figure 5C:
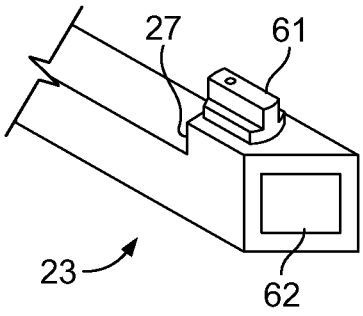
FIG. 5C is a diagram of an embodiment of a protruding bracket support that may be attached to or formed on an inner wall of a refrigerator to support a rotatable shelf assembly and which further comprises a latch in an unlocked position.
Figure 5D:
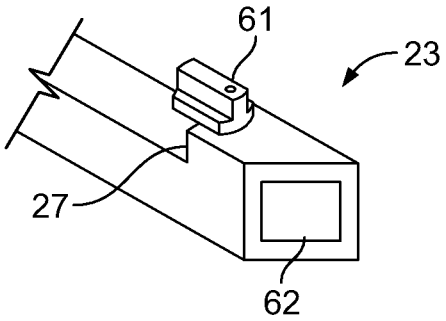
FIG. 5D is a diagram of an embodiment of a protruding bracket support that may be attached to or formed on an inner wall of a refrigerator to support a rotatable shelf assembly and which further comprises a latch in an locked position.
Figure 5E:
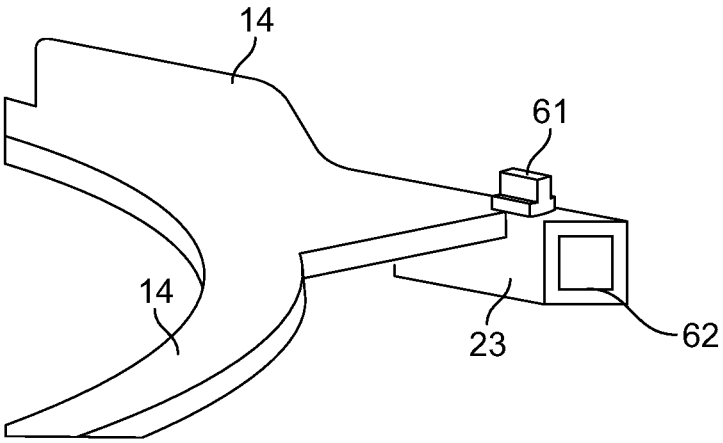
FIG. 5E is a detailed view an embodiment of a protruding bracket support engaging a support bracket with a latch in a locked position.

One non-limiting example of a protruding bracket support 23 is shown in FIG. 5C-5E. In this embodiment of bracket support 23, a notch 27 is included to further provide support for support bracket 4. Notch 27 may be sized to appropriately receive at least one flange 5 of support bracket 4. Notch 27 may further be configured to limit translational movement of support bracket 4 once installed into the refrigerator. Bracket support 23 may also include, in some embodiments, a latch 61 that may secure the upward motion of support bracket 4 once installed into bracket support 23. FIG. 5E illustrates a partial view of a support bracket 4 secured by a latch 61 into bracket support 23. Latch 61 may rotate into place to limit the upward motion of support bracket 4. In other embodiments, latch 61 may slide into place to limit the upward motion of support bracket 4. In some embodiments, latch 61 may lock after latch 61 slides or rotates into place. In some embodiments, bracket support 23 may not include latch 61.

Figure 5F:
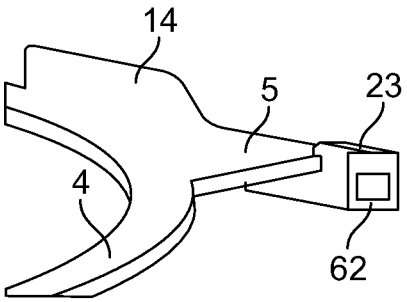
FIG. 5F is a detailed view of an additional embodiment of a protruding bracket support engaging a support bracket wherein the bracket support is configured to limit the upward motion of a support bracket.
Figure 5G:
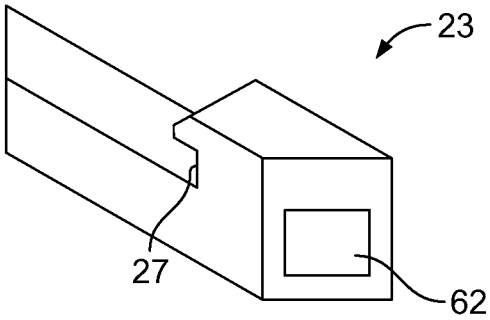
FIG. 5G is a diagram of a perspective view of an support bracket which may be configured to limit the upward motion of a support bracket.
Figure 5H:
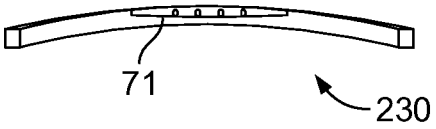
FIG. 5H is a diagram of an embodiment of a recessed bracket support which may include a spring.

FIG. 5G illustrates an alternative embodiment of a bracket support 23 configured to limit the upward motion of support bracket 4. In this embodiment, notch 27 may be configured to comprise an overhang. The overhanging notch 27 may limit the upward motion of support bracket 4 when installed therein, as seen in FIG. 5F. As pictured in FIG. 5H, a recessed bracket support 230 may further comprise a spring 71 configured to push a support bracket 4 forward when inserted into a recessed support bracket 23. This configuration may be used in conjunction with a bracket support 23 as pictured in FIGS. 5F and 5G. Spring 71 may provide a forward force that may help maintain support bracket 4 beneath overhanging notch 27.

It should be understood that various embodiments of the invention may include any combination of various embodiments of bracket supports 23, 230. For example, embodiments can include both a plurality of protruding bracket supports 23 and recessed bracket supports 230. In other embodiments, the invention may comprise only protruding or only recessed bracket supports. It is also contemplated that in certain embodiments the types of bracket supports 23, 230 selected should be configured to specifically receive or support a specific embodiment of support bracket 4.

As illustrated in FIGS. 5A and 5B, in some embodiments, interior walls 16, 161 may be configured to include at least one supply vent 24 and at least one return vent 25. In the embodiment of FIG. 5A and 5B, four supply vents 24 are spaced vertically along rear portion interior wall 161 in one rear corner of refrigeration space 29 and four return vents 25 are spaced vertically in the opposite rear corner of refrigeration space 29. This example is, however, non-limiting, and greater or fewer supply vents 24 and return vents 25 are contemplated located at other positions in interior walls 16, 161. In some embodiments, supply vents 24 and return vents 25 are spaced evenly along the vertical length of interior walls 16, 161; however, in other embodiments the spacing need not be uniform. Further, in some embodiments, it is contemplated that at least one supply vent 24 and one return vent 25 may be provided for each possible shelf installation location. This means that in some embodiments, supply vents 24 and return vents 25 may be spaced so that a horizontal row of bracket supports 23, 230 may be interspersed between each row of supply vents 24 and return vents 25. In some embodiments supply vents 24 and return vents 25 are connected to ductwork and other mechanical components necessary to provide refrigerated air that are located in at least one cavity 17.

In one embodiment of the spacing of supply vents 24 and return vents 25, supply vents 24 may provide refrigerated air in one rear corner of the refrigerator and return vents 25 may be located in the opposite rear corner. This may produce a circular or substantially circular airflow pattern. This embodiment of vent placement may achieve improved temperature distribution throughout the refrigerator. However, it should be understood that this example is non-limiting, and that other vent positions and airflow patterns are contemplated.

In some embodiments interior walls 16, 161 may be made from or coated with a low-friction material; this may, in some embodiments, prevent items stored on rotatable shelf assemblies 1 from binding with inner wall 16 when the rotatable shelf assembly 1 rotates.

Figure 6A:
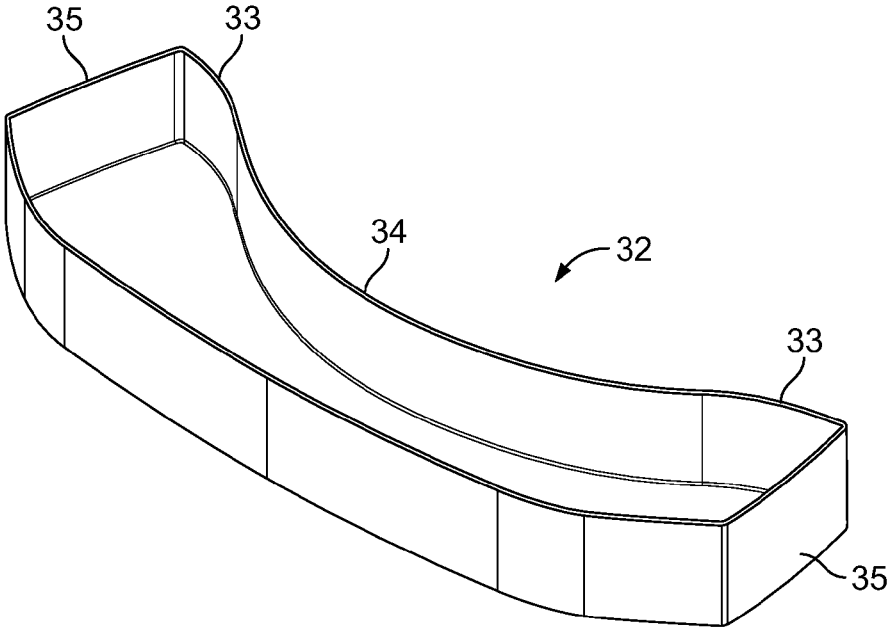
FIG. 6A is a perspective view of an embodiment of a refrigerator door shelf configured for use in some embodiments of the invention.
Figure 6B:
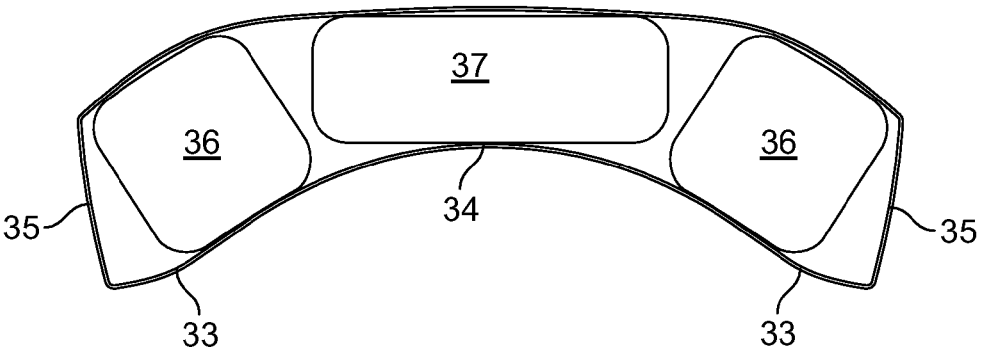
FIG. 6B is a top view of the door shelf seen in FIG. 6A, which further shows the locations of various areas within the door shelf.
Figure 13:
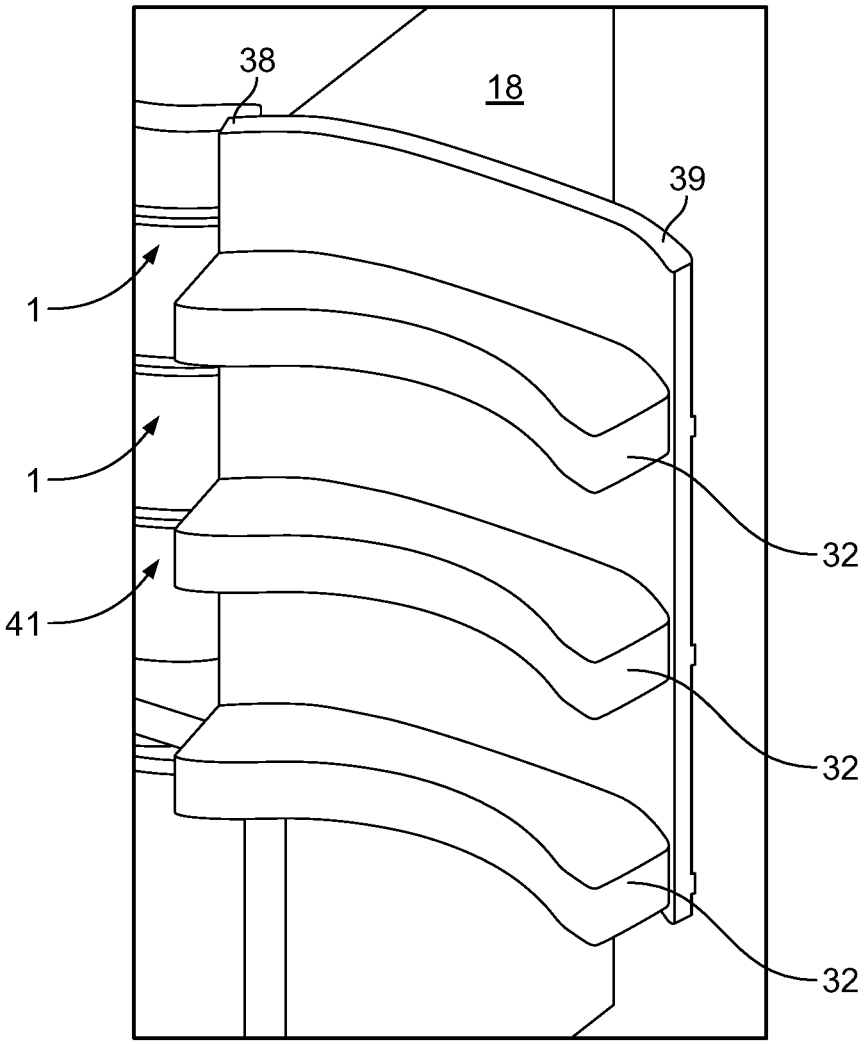
FIG. 13 is a diagram depicting the placement of refrigerator doors helves on a refrigerator door in an open position.

Referring now to FIG. 13 and FIGS. 6A-6B, an embodiment of a refrigerator door 39 and at least one door shelf 32 configured for use in a refrigerator 18 with substantially circular shelves will be described. In some embodiments, door shelf 32 may be configured to provide storage in the space between a substantially circular shelf and door 39. In some embodiments door 39 comprises at least one door shelf 32 attached to its inner surface. Door 39 may include one or more door shelves 32 attached thereto and distributed vertically along the height of the door. In some embodiments, door shelves 32 may be configured to be removable from door 39. Further, in some embodiments door 39 may be configured to receive door shelves 32 at a plurality of vertical locations, such that a user may customize the placement of door shelves 32.

Door 39 may be attached to the refrigerator by a pivot 38 located on one of the sidewalls of refrigerator 18 and at one end of door 39. In some embodiments pivot 18 may be located on either the left or right side of refrigerator 18. The door 39 may further comprise a layer of insulation configured to help maintain the desired temperature inside the refrigerator 18. In some embodiments, door 39 may be attached to a pivot 38 at each of the ends of door 39. In this embodiment, the door 39, and door shelves 32, may be divided into two parts so that each part may pivotally open from the center. This type of door is commonly referred to as a French-style door.

Door 39 may also be shaped so that it arcs outward, away from the interior of the refrigerator. This may provide increased room for storage and for door shelves 32 inside the refrigerator. However, in other embodiments, door 39 may be shaped so that it may be substantially flat.

Referring now to FIG. 1C and FIGS. 6A and 6B, door shelf 32 will be described in greater detail. The shape of door 39 and door shelves 32 may, in some embodiments, be optimized to allow for increased storage space within the refrigerator. As used herein an arc is an arc with a significant length which is greater than 1 mm and significant width which is greater than 1 mm and a radius is a radius with a significant length and a significant width; the same applying to "arcs," "radii." "center arc," "center arcs," and so forth. The inner most wall of door shelf 32 may be formed from standard materials in the shape of three arcs. First, a center arc 34, may closely follow the outer edge portion of a circular shelf installed into the refrigerator. In some embodiments this center arc 34 may have a radius equal to or slightly larger than the outermost radius of a rotatable shelf assembly 1. Several non-limiting examples of center arc 34 may be at 0, 0.1, 0.2, or 0.25 inches larger than the outermost radius of a rotatable shelf assembly 1. The other two arcs 33 are located at the extremities of the inner wall of door shelf 32. The other arcs 33 may be configured to arc away from the circular shelf and may further be configured to allow a narrow clearance between door shelf 32 and the circular shelf as door 39 is rotated outward. In some embodiments arcs 33 on each end of the inner edge portion of door shelf 32 are mirror image configurations of each other. In other embodiments, only one side of door shelf 32 includes arc 33.

In some embodiments of door shelf 32, sidewalls 35 of door shelf 32 may also be formed in the shape of arcs. These arcs may be configured to provide clearance between door shelf 32 and the ends of the refrigerator walls 162 as door 39 is rotated outwards. In other embodiments, sidewalls 35 may be substantially straight.

Referring now to FIG. 6B, one non-limiting embodiment of a door shelf 32 is described in detail. In this embodiment, the dimensions of the door shelf 32 and outer door 39 are such that the door shelf is configured to accommodate a standard one-gallon jug at each end 36 of the door shelf 32. In some embodiments, the door shelf is configured to accommodate a container that is 9.75 inches high with a substantially square base with the dimensions of 5.75 inches by 5.75 inches. Further, the center section 37 of the door shelf 32 may be configured to accommodate a standard egg carton, which may be generally 12 inches long, generally 4 inches wide and generally 2.75 inches deep or for 18-egg carton which is generally, 2.75 inches by generally 12 inches by generally 6.25 inches. In some embodiments the door shelf is configured to accommodate an egg carton in the middle section 37 and at least one one-gallon container of milk on the sides 36 of the door shelf 32.

In some embodiments, the corners and wall intersections of door shelf 32 may be filleted. Possible manufacturing process for door shelf 32 may include plastic injection molding, blow molding, and plastic thermoforming, or any other suitable process. In some embodiments, door shelf 32 may be made from polycarbonate, acrylic, vinyl, or other plastics, or any other suitable material.

Referring now to FIGS. 7A-7E, various features and embodiments of a rotating drawer assembly 41 for use in a refrigerator are shown. In some embodiments, rotating drawer assembly 41 may be configured to allow it to slide towards the user and/or to rotate.

One non-limiting example of rotating drawer assembly 41 is described as follows. Rotating drawer assembly 41 may comprise outer drum 42, inner drum 43, and bearing ring 3 disposed between outer drum 42 and inner drum 43 to facilitate the rotation of inner drum 43 relative to outer drum 42. Items to be stored may be placed in inner drum 43, which may be further partitioned by variously configured dividers 44 to create separate spaces within inner drum 43.

Figure 7A:
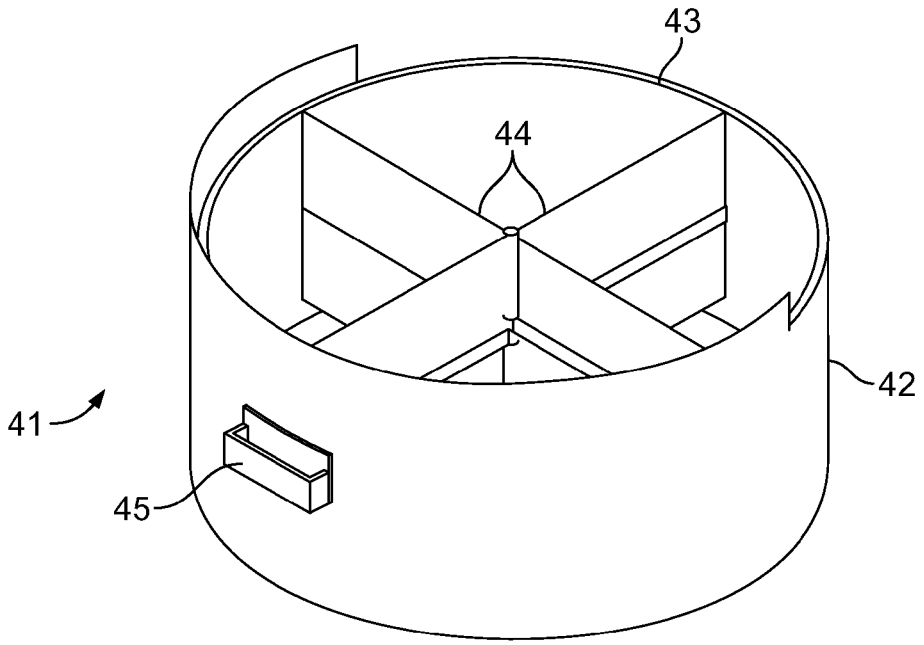
FIG. 7A is a diagram of a perspective view of an embodiment of a rotating drawer assembly for use in a refrigerator.
Figure 7B:
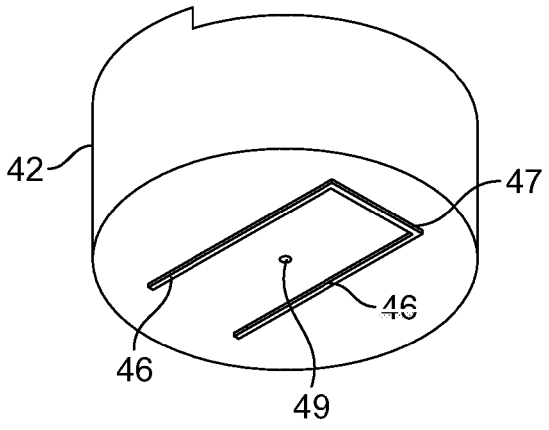
FIG. 7B is a diagram of a bottom perspective view of one embodiment of an outer drum configured for use in a rotating drawer assembly.

In some embodiments, outer drum 42 also may include handle 45 configured to allow a user to grip when sliding rotating drawer assembly 41 outward from refrigerator 18. Referring to FIG. 7B, a bottom view of an embodiment of outer drum 42 is shown. Outer drum 42 may be substantially cylindrically shaped, with an open top and closed bottom. In some embodiments the outer diameter of outer drum 42 may be slightly less than the inner width of refrigerator 18. The outer radius of outer drum 42 may also be configured to follow the radius of a curved rear portion of interior wall 161 of refrigerator 18.

Some embodiments of outer drum 42 may include at least one groove 46 configured to interlock with at least one corresponding groove 51 located on divider 29 of refrigerator 18, as seen in FIG. 5A and 5B. When these grooves 42, 51 are mated, outer drum 42 may slide in the direction of the grooves 42, 51 when pulled or pushed by the user. In some embodiments either or both grooves 42, 51 may include bearings to facilitate the translational sliding. As pictured in FIG. 7A, outer drum 42 may also, in some embodiments, include at least one stopping groove 47 configured to limit the translational sliding of outer drum 42 by the means of front bar groove of 51. It is contemplated that other elements may be used to limit the translational sliding range of outer drum 42.

Figure 7C:
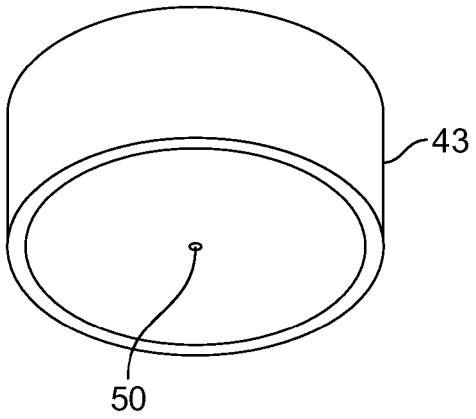
FIG. 7C is a diagram of a bottom perspective view of one embodiment of an inner drum configured for use in a rotating drawer assembly.

Referring now to FIGS. 7B and 7C, which depict bottom views of embodiments of outer drum 42 and inner drum 43. Inner drum 43 may be substantially cylindrically-shaped with an open top and closed bottom. The outer diameter of inner drum 43 may be configured to be slightly smaller than the inner diameter of outer drum 42, such that the inner drum 43 may be placed inside the outer drum 42 with a small clearance. In some embodiments, outer drum 42 may also include a small hole or recess 49 in its bottom surface configured in size and shape to selectively mate with a nub or protrusion 50 in the center of the bottom surface of inner drum 43. This configuration may maintain a substantially fixed concentric relationship between outer drum 42 and inner drum 43.

Figure 7D:
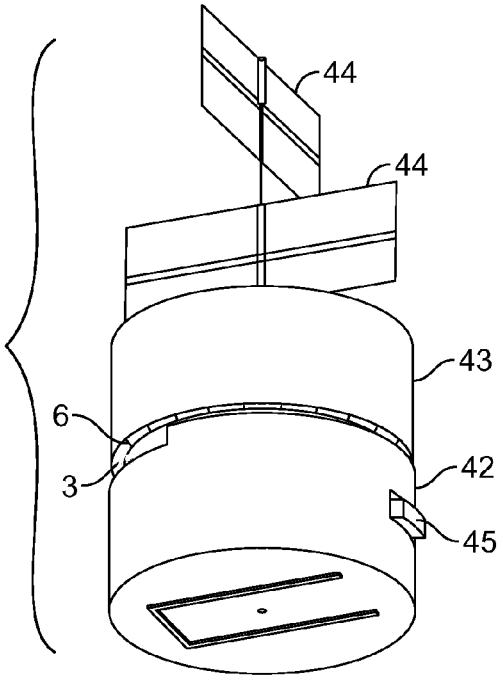
FIG. 7D is a diagram of an exploded view of an embodiment of a rotating drawer assembly as seen from a bottom perspective view, which shows the placement of a bearing ring between an outer drum and an inner drum.
Figure 7E:
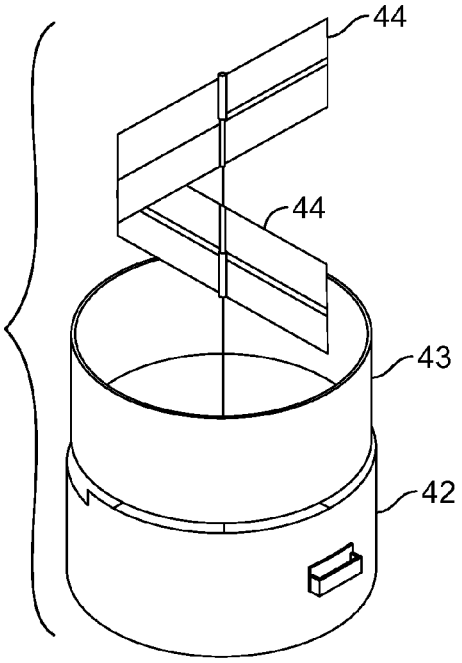
FIG. 7E is a diagram of an exploded view of an embodiment of a rotating drawer assembly as seen from a top perspective view.

An exploded view of an embodiment of a rotating drawer assembly 41 is shown in FIGS. 7D and 7E from a bottom and top perspective. In this embodiment shown in FIG. 7D, a bearing ring 3 is included between outer drum 42 and inner drum 43 to facilitate the rotation of inner drum 43 relative to outer drum 42. In some embodiments, bearing ring 3 may comprise a bearing ring 3 as pictured in FIG. 14A or FIG. 12, or in FIG. 12 with at least one bearing 6 removed or at least one bearing 8 removed.

In some embodiments as shown in FIG. 7D and FIG. 7E, inner drum 43 is further configured to receive at least one divider 44 that may be configured to partition inner drum 43 into a plurality of spaces. In some embodiments as shown in FIG. 7D and FIG. 7E, the at least one divider 44 may be used to partition inner drum 43 into two, three, four, or more spaces. The at least one divider 44 may be used to divide inner drum 43 into radially divided sections. Divider 44 may be designed to lock in place when pushed all the way down. Also divider 44 may be configured to be able to rotate when divider 44 is lifted slightly upward; this may allow divider 44 to be able to be rotated until a desired partition angle is achieved and then divider 44 may be pushed down to lock divider 44 into place at the desired angle. In other embodiments, one or more dividers 44 may be configured to divide the inner drum into substantially parallel sections by forming chords across inner drum 43. In some embodiments, no dividers 44 may be used and inner drum 43 may remain unpartitioned. In some embodiments, the lip of inner drum 43 may be configured to comprise a high friction surface that may be gripped by a user when rotating inner drum 43. Inner drum 43 can also be rotated by rollers 55 protruding through slots 26.

Figure 8A:
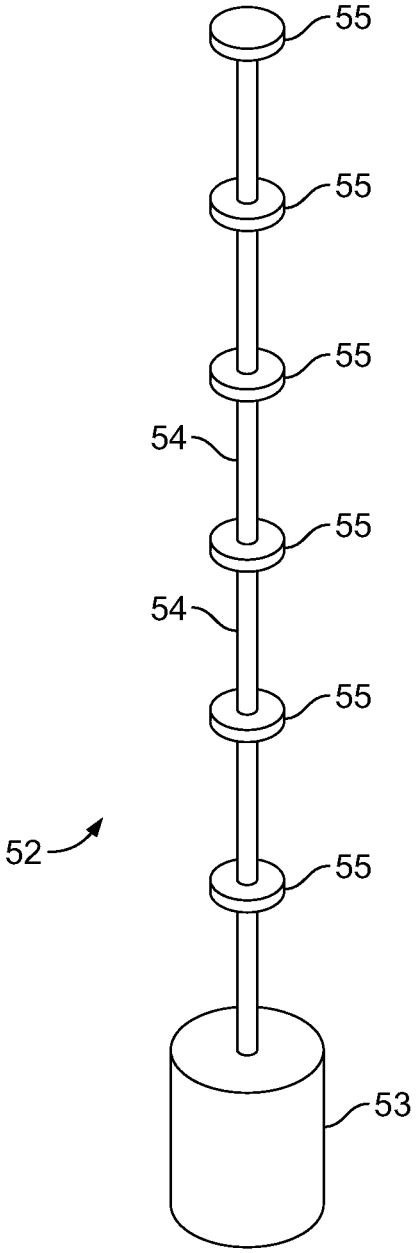
FIG. 8A is a diagram of an embodiment of a motorized rotation assembly configured to cause the rotation of turntables disposed within a refrigerator.
Figure 8B:
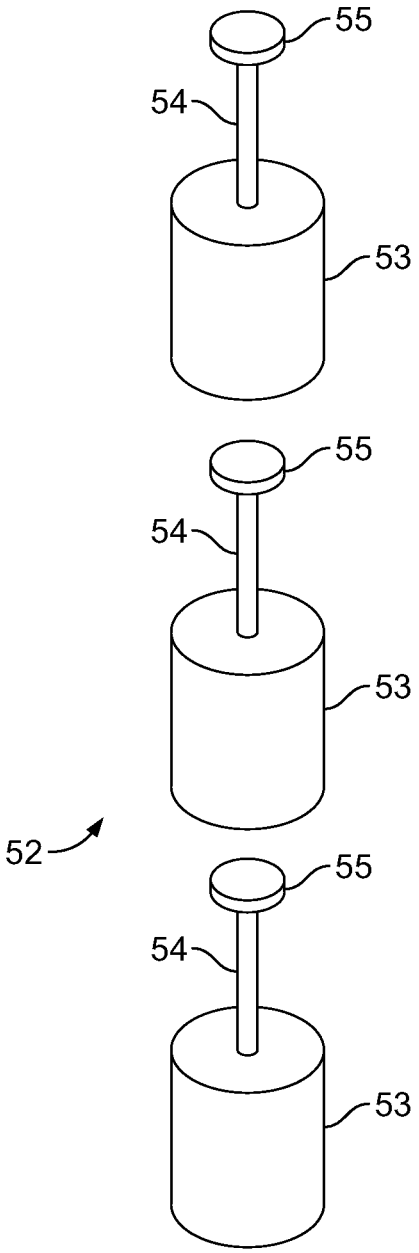
FIG. 8B is a diagram of an alternative embodiment of a motorized rotation assembly comprising a plurality of electric motors.

In some embodiments of the invention, at least one rotatable shelf assembly 1 or one rotating inner drum 43 may be coupled to a motor 53, such as an electric motor, that may be configured to cause the rotation of at least one turntable 2 or drum 43. Referring now to FIGS. 8A and 8B various embodiments of motorized rotation assemblies 52 are shown. In FIG. 8A, an embodiment of a motorized rotation assembly 52 may comprise an electric motor 53 coupled to a shaft 54 on which a plurality of rotation wheels 55 are disposed. In this embodiment, an electric motor 53 may be configured to cause the rotation of shaft 54, which thereby causes the rotation of a plurality or rotation wheels 55 which may be rigidly attached to shaft 54.

In some embodiments, at least one motorized rotation assembly 52 may be disposed in at least one cavity 17 seen in FIGS. 1C and 5A. The spacing of a plurality of rotation wheels 55 may be configured to align with the spacing of a plurality of slits 26 disposed on interior walls 16, 161 of refrigerator 18, as seen in FIGS. 5A and 5B. Slits 26 may be configured in size and shape so as to allow a substantially small portion of rotation wheels 55 to protrude through slits 26 into refrigeration compartment 28. In some embodiments of the invention, at least one rotation wheel 55, protruding from cavity 17 through slit 26 into refrigeration compartment 29, may make contact with an outer edge portion of at least one turntable 2. The contact portion between rotation wheel 55 and an outer edge portion of turntable 2 may be configured to cause turntable 2 to rotate when electric motor 53 is activated.

As pictured in FIG. 8A, in some embodiments a single electric motor 53 may be coupled to a plurality of rotation wheels 55 such that when electric motor 53 is activated a plurality of rotation wheels 55 all turn in unison. The activation of electric motor 53 may also cause a plurality of turntables 2 disposed inside a refrigerator 18 to all turn unison. However, as seen in FIG. 8B, in some embodiments of the invention, a plurality of electric motors 53 may be coupled to individual rotation wheels 55. This may allow the rotation of rotation wheels 55 and turntables 2 individually, when each corresponding electric motor 53 is activated.

In some embodiments, the invention may include a motor 53 to stop the rotation rapidly, or let the turntable shelf slow down gradually. A rotation damper may be placed around shaft 54, or contacting shaft 55 to resist rotation speed of 54, or 55. This is damper is made for when motor 53 receives not voltage from 72, the rotation of turntable 1 will quickly stop.

In some embodiments, the invention may include a motor 53 with a solenoid function built in motor 53. When the voltage from control circuitry 72 receives a voltage to revolve turntable 1 and drum 43, the internal magnets of motor 53 push the commutator of 53 forward interlocking or contacting shaft 54. When voltage from 72 ceases, the commutator will disengage and let 54, and 55 freely rotate. This would allow the user to feel no resistance of the motor 53 while attempting to manually rotate assembly 1.

In some embodiments, the invention may include one, two, three, four, five, six, seven, eight, or more rotation wheels 55 coupled to one, two, three, four, five, six, seven, eight, or more electric motors 53. In some embodiments, rotation wheels 55 and electric motors 53 may be configured to operate in unison, while in other embodiments, rotation wheels 55 and electric motors 53 may be configured to be independently operable, with each electric motor 53 coupled only to one or some of the rotation wheels 55.

Rotation wheels 55 may, in some embodiments, comprise a high friction outer surface configured to engage an outer surface of turntable 2, which may also be configured to comprise a high friction outer surface. In some embodiments, outer surfaces of rotation wheels 55 and turntable 2 may be coated with or comprise high friction rubber, small bumps or ridges, or interlocking teeth.

Motorized rotation assembly 52 may be disposed within at least one cavity 17 and attached to the inner walls 161, 162 of at least one cavity 17 with springs configured to either pull or push motorized wheels 55 through slits 26.

Electric motors 53 may be configured to allow rotation in a clockwise direction or a counter-clockwise direction. Electric motors 53 may further be connected, in some embodiments to control circuitry 72 configured to activate electric motors 53 when predetermined events occur. For example, in some embodiments, electric motors 53 may be configured to activate, causing rotation of turntables 2 or inner drum 43 (shown in FIG. 7) when the refrigerator door 39 is opened, when a compressor 63 of refrigerator 18 is running, or when both the refrigerator door 39 is opened and when a compressor 63 of refrigerator 18 is running FIGS. 9E and 9F provide a non-limiting examples of logic that control circuitry 72 may use to provide automated rotation of at least one rotatable shelf assembly 1. In some embodiments, further discussed below, electric motors 53 may be configured to be controllable in response to user hand gestures.

In some embodiments, electric motors 53 may be connected to operation controls disposed within the refrigeration space 28, on door 39, or on an outer surface of refrigerator 18.

Operation controls may include switches 71, which may include buttons or proximity sensors 70, configured to allow a user to control the rotation of turntables 2. Switches may be configured to control which turntables 2 rotate and in which direction the rotation occurs. The placement of proximity sensors in some embodiments of the invention, on the side portions of interior walls 16 may be seen in FIGS. 5A and 5I. They may be touchless sensors for sanitation purposes.

Figure 9A:
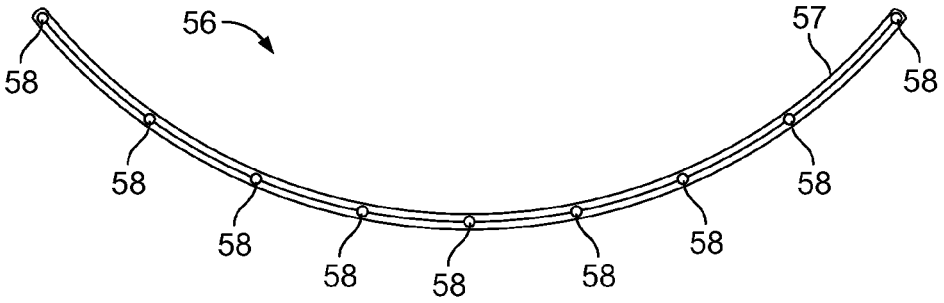
FIG. 9A is a diagram of an embodiment of a sensor array configured for use in some embodiments of the invention.
Figure 9B:
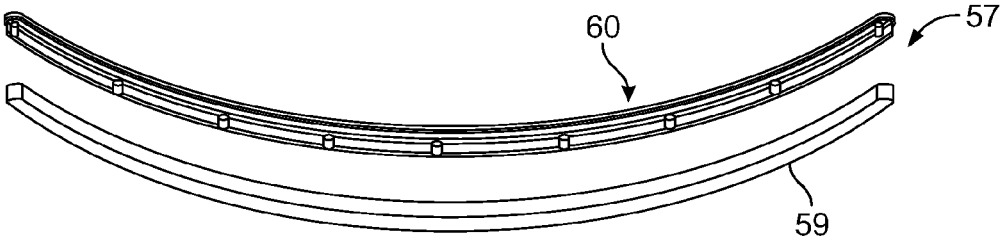
FIG. 9B is a diagram of an exploded view of a two-part housing for use in an embodiment of a sensor array.

Referring now to FIG. 9A and 9B, an embodiment of a sensor array 56 is shown that may be used in some embodiments of the invention. Sensor array 56 may comprise a housing 57 and a plurality of sensors 58 disposed therein. In some embodiments the housing 57 is formed from an upper shell 60 and a lower shell 59, with the sensors 58 disposed on upper shell 60, on lower shell 59, or between upper shell 60 and lower shell 59. The housing 57 may be shaped in an arc with a radius configured to substantially follow the outer radius of rotatable shelf assembly 1. In other embodiments, the sensor array housing 57 may be configured to be substantially straight.

Sensor array 56 may comprise a strip of several sensors 58 positioned around an arc that has a radius substantially similar to the outside radius of rotatable shelf assembly 1. Sensor array 56 may be mounted on the ceiling of refrigerator 18, as seen in FIGS. 1A and 9D, or embedded in refrigeration space 28 and assembled in projected alignment with the outer diameter of rotatable shelf assembly 1. Sensor array 56 may also be installed in the base of refrigerator 18 or divider 29 with the top of the upper shell 60 level or substantially level with base of refrigerator 18 or divider 29. Sensors 58 may be angularly arrayed or arranged in a horizontal-pattern. In some embodiments a sensor array may be positioned in a substantially vertical alignment along the left inner wall of refrigerator 18 or the right inner wall of refrigerator 18. The spacing of sensors 58 may be configured so as to not exceed the width of an average hand or not to exceed six inches. In some embodiments, the sensor array 56 may comprise 8, 9, 10, 11, 12, 13, 14, 15, 16, 17, 18, 19, 20, 21, 22, 23, 24, or more sensors 58, although it should be understood that greater or fewer sensors 58 are contemplated. The spacing of the sensors 58 may be 0.5, 1.0, 1.5, 2.0, 2.5, 3.0, 3.5, 4.0, 4.5, 5.0, 5.5, or 6.0 inches apart, although it should be understood that larger or smaller spacing distances are contemplated; additionally the spacing between two adjacent sensors may be equal or non-equal.

In some embodiments, sensor array 57 may be attached to either the roof or floor of a refrigeration compartment 29 of a refrigerator 18 and a reflector or additional sensor array 57 may be aligned at the opposing end. Sensor array 57 may further be positioned so that the sensors 58 are just beyond the outer boundary of a rotatable shelf assembly 1. The positioning of sensor array 57 may be configured to allow for sensing of a user's hand by the sensor array as it enters over rotatable shelf assembly 1 or is waived in front of rotatable shelf assembly 1.

Figure 5I:
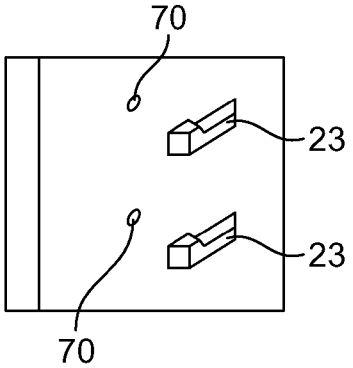
FIG. 5I is a diagram of the placement of sensors relative to bracket supports for use in some embodiments of the invention.

Sensors 58, may, in some embodiments, comprise proximity sensors or any other suitable type of sensor. In some embodiments, the proximity sensor may comprise an infrared sensor. Other touchless sensors 70 may be located on the right and left side portions of interior wall 16, as seen in FIGS. 5A and 5I. Further, protruding support brackets may also comprise additional sensors 62, as seen in FIGS. 5C-5G. In some embodiments, sensors 58 is a single sensor which is configured to detect the absence or presence of an object.

Figure 9C:
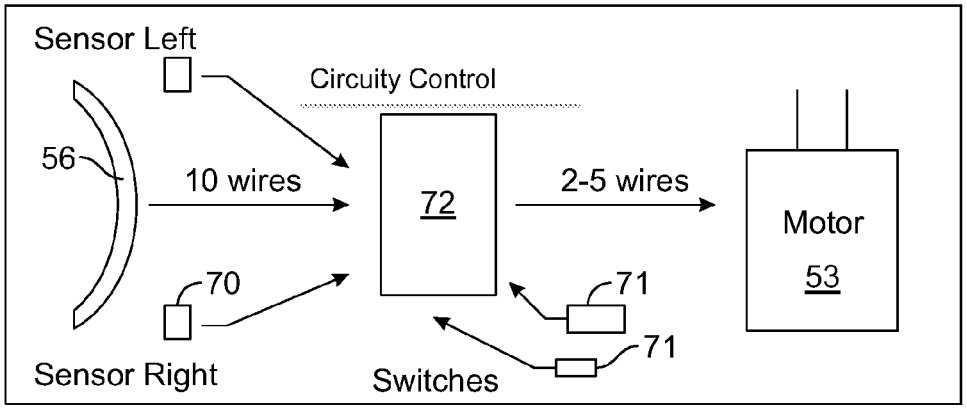
FIG. 9C is a wiring diagram for use with some embodiments of the invention.
Figure 9D:
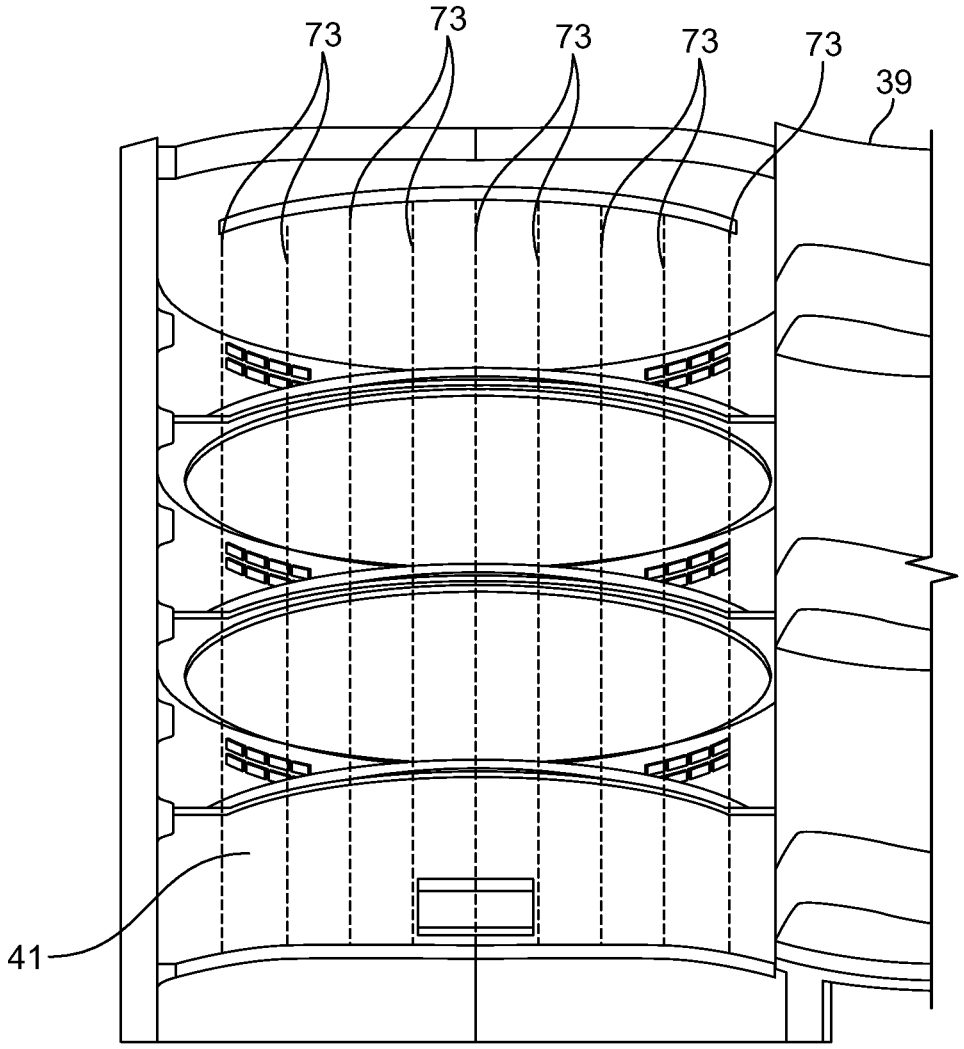
FIG. 9D is a diagram illustrating the placement of sensor beams in some embodiments of the invention.
Figure 9E:
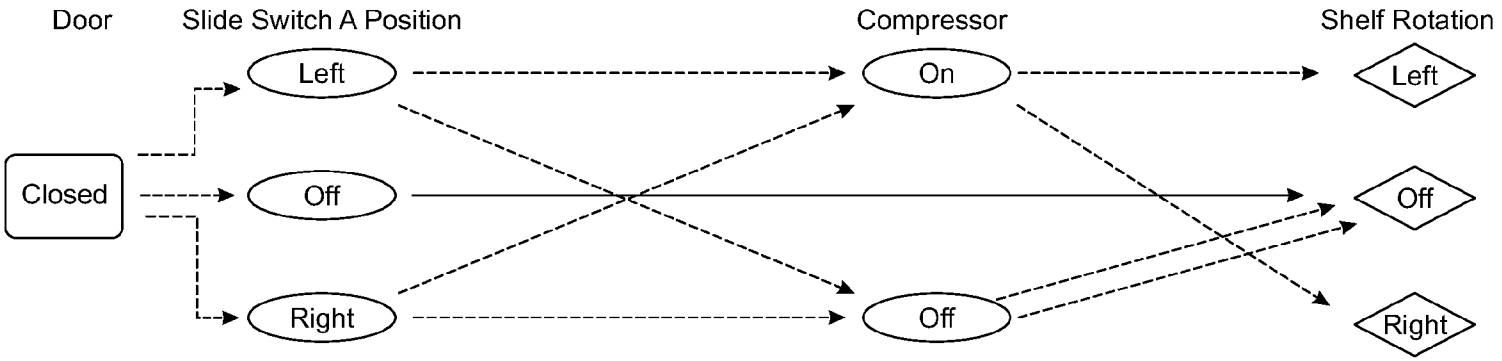
FIG. 9E is a logic flowchart illustrating automation programming in some embodiments of the invention when the refrigerator door is in a closed position which may be used to cause the rotation of rotatable shelving when a compressor of a refrigerator is running.
Figure 9F:
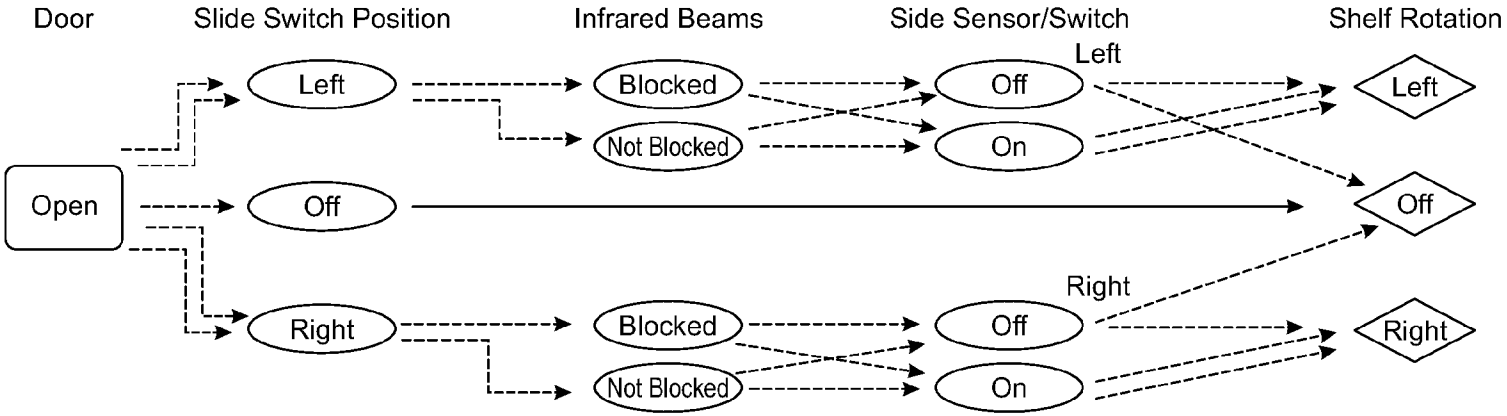
FIG. 9F is a logic flowchart illustrating automation programming in some additional embodiments of the invention when refrigerator door is in an open position which may be used to control clockwise and counter-clockwise rotation of rotatable shelving.

FIG. 9C illustrates a wiring diagram that may be used with some embodiments of the invention. Sensors 58 of sensor array 56 may be wired to control circuitry 72. Similarly touchless sensors 70 located on the right and left side portions of interior wall 16 may be wired to control circuitry 72. Switches 71 may also be connected to control circuitry 72. Control circuitry 72 may then be wired to electric motors 53. In some embodiments, control circuitry 72 is wired to a plurality of electric motors 53 and may control each of the plurality of electric motors 53 individually, while in other embodiments control circuitry 73 is wired to a single electric motor 53. Control circuitry 72 may further be programmed to control the activation of electric motors 53 in response to user inputs sensed by sensors 58, 72 and/or received from switches 71 and touchless sensors 70.

Referring now to FIG. 9D, an embodiment of a sensor array 57 comprising nine sensors 58 is depicted. In this example, the nine sensors 58 create nine sensor beams 73, wherein each individual sensor 58 creates a single vertical sensor beam 73 that passes in front of a portion of at least one rotatable shelf assembly 1 installed within refrigerator 18. In this way an array of sensor beams 73 is formed in the opening of the refrigerator 18, in front of at least one rotatable shelf assembly 1. This array of sensor beams 73 may be positioned to detect inputs from a user's hand passing through the sensor beams 73 in front of or over a rotatable shelf assembly 1 installed within refrigerator 18. An input, for purposes of this disclosure, is defined as the signal received from a single sensor 58 when that sensor's sensor beam 73 is broken, or, in other words, when a user's hand or any other objects which are larger than a predetermined threshold pass through the sensor beam 73. (For example, the threshold may be configured so that control circuitry 72 may detect a thin object such as a pencil but not miniscule objects such as smoke or dust particles.)

Figure 9G:
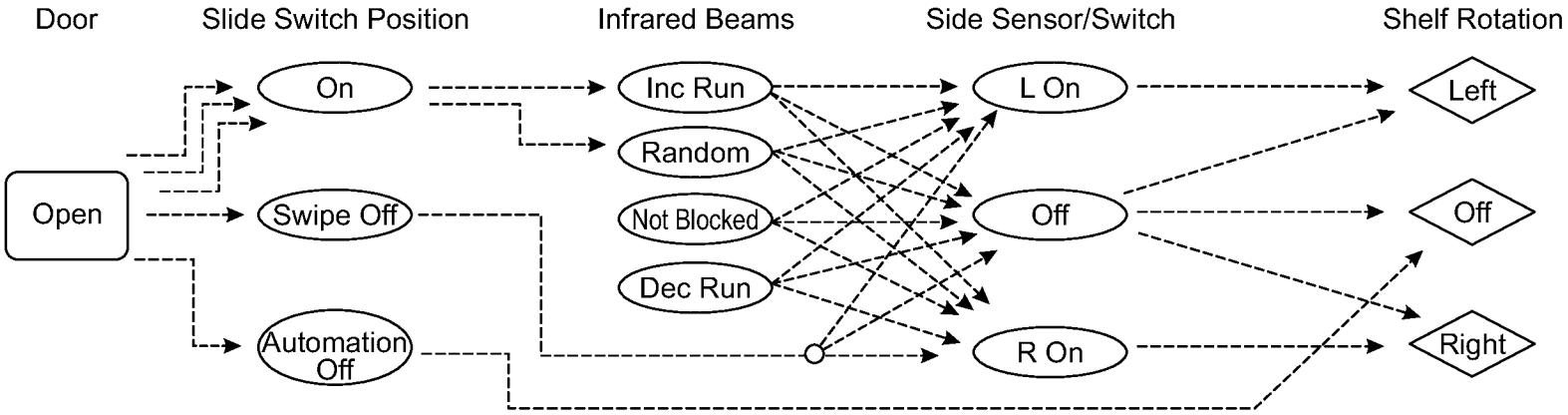
FIG. 9G is a logic flowchart illustrating automation programming in some additional embodiments of the invention which may be used to control clockwise and counter-clockwise rotation of rotatable shelving in response to user hand gestures.

Control circuitry 72 may be connected to sensors 58, as seen in FIG. 9C, so that control circuitry 72 may process inputs received from sensors 58. An output of control circuitry 72 may further be connected to electric motors 53 such that control circuitry 72 can activate or deactivate electric motors 53 in response to the inputs received from sensors 58. Control circuitry 72 may further be connected to switches 71 and touchless sensors 70 that may be configured to provide further automation control, including, but not limited to, enabling or disabling automation and selecting between various control schemes, as seen in FIGS. 9E-9G. Control circuitry 72 may further comprise a timer that is configured to record the time between different inputs.

Control circuitry 72 may thus be configured to control the rotation of turntables 2 in response to patterns in the inputs received from sensors 58 which are received within a specified time limit. For purposes of this disclosure, a pattern is defined to be a series of inputs, received from various sensors, within a specified time limit. Various patterns in the inputs received from the sensors 58 may cause the control circuitry 72 to start or stop the rotation of turntable 2 in either a clockwise or counter-clockwise direction, reverse the direction of rotation, or alter the speed of the rotation, either by causing the rotation to accelerate or decelerate.

For example, if control circuitry 72 receives a first input from a first sensor followed by a second input from a second sensor immediately adjacent to the first sensor, within a specified time limit, and then receives no additional input within a second specified time limit, from the time the second input was received, this pattern may signal the control circuitry stop the rotatable shelf assembly from rotating. This input pattern may reflect the input pattern created when a user reaches directly over or in front of the turntable 2. In other embodiments, the first and second input may not need to be received from immediately adjacent sensors in order to signal control circuitry 72 to stop rotation of turntable 2. Further, in other embodiments, the pattern signaling control circuitry 72 to stop rotation of turntable 2 may comprise three or more input signals received from nonadjacent sensors.

Similarly, if control circuitry 72 receives sequential inputs from sequential sensors—i.e., if it receives a first input from a first sensor followed by a second input from a second sensor followed by a third input from a third sensor, where the first sensor is located immediately adjacent to the second sensor on one side of the second sensor, and the third sensor is located immediately adjacent to the second sensor on the opposite side of the second sensor, within a specified time limit—this may signal control circuitry 72 to rotate turntable 2 in either a clockwise or counter-clockwise direction. This input pattern may reflect the pattern created when a user waves his hand, either to the right or the left, through the array of sensor beams 73. In other embodiments these patterns may be modified. For example, control circuitry 72 may require that three, four, five, six, or more sequential inputs be received to trigger the rotation of turntable 2.

The direction in which the sensor beams 73 are broken, will create a pattern of inputs in the corresponding direction. Control circuitry 72 may be configured to recognize the direction in which the inputs are received and rotate turntable 2 in that direction. For example, if a first input is received, followed by a second input from a sensor immediately to the right of a first sensor, followed by a third input from a sensor immediately to the right of the second sensor, this may cause the control circuitry 72 to rotate turntable 2 in a clockwise direction. If a first input is received, followed by a second input from a sensor immediately to the left of a first sensor, followed by a third input from a sensor immediately to the left of the second sensor, this may cause the control circuitry 72 to rotate turntable 2 in a counter-clockwise direction. In some embodiments, the directions of these two examples may be reversed.

In some embodiments, a timer in control circuitry 72 may require that each additional input be received within 1.5 seconds of the last input. Thus, if a first input is received and a second input is received 2 seconds later, the control circuitry may possibly not recognize a pattern, as the two inputs were not received within the specified time limit. In some embodiments the time limit may require that consecutive inputs be received within 2, 1.5, 1, 0.5, 0.25 or less seconds of the preceding input. Further, in other embodiments, the time limit may be shortened after each additional input is received. For example, control circuitry 72 may be configured to require that a second input is received within 1.5 seconds of a first input but that a third input be received within 0.5 seconds of the second.

Control circuitry 72 may further be configured, in some embodiments, to require different minimum numbers of inputs within the specified time limits to recognize a pattern. For example, in one embodiment, control circuitry 72 may be configured to require that more than a single input be received within the time limit to recognize a pattern and trigger an action. Control circuitry 72 may further be configured to recognize that a minimum of two inputs within a specified time limits as a pattern. For example, if a first input is received and a second input is received before the time limit expires, control circuitry 72 may be configured to recognize this as a pattern and trigger an action, even if no further inputs are received. Control circuitry 72 may likewise be configured to require three or more inputs to be received before recognizing a pattern and triggering an action.

In some embodiments, control circuitry 72 may be configured to recognize a maximum number of inputs as a pattern that triggers an action. Control circuitry 72 may be configured to disregard additional inputs after a maximum number of inputs is received. For example, control circuitry 72 may be configured to recognize a maximum of three inputs within a specified time limit as a pattern. If control circuitry 72 receives consecutive inputs from a first, second, third, and fourth sensor, the fourth sensor's input is discarded because the first, second, and third sensors' inputs were already recognized as a pattern. In some embodiments, control circuitry 72 may be configured so that two, three, four, five, or more consecutive inputs are recognized as the maximum number of inputs required to form a pattern and trigger an action. Control circuitry 72 may also be configured to include a delay time before an additional input may be received after a pattern is recognized. In some embodiments, the control circuitry 72 may be configured to discard additional inputs until 0.1, 0.25, 0.5, or more seconds after a pattern is recognized.

In some embodiments, control circuitry 72 may further be configured to control the speed of rotation of a rotatable shelf assembly in response to input patterns received. In some embodiments, this may be achieved by recording the time that elapses between consecutive inputs and adjusting the speed of rotation accordingly. For example, if two consecutive inputs are received with 1 second elapsing there between, control circuitry may cause the rotation of turntable 2 at a first speed. However, if two consecutive inputs are received with 0.5 seconds elapsing there between, control circuitry 72 may cause the rotation of a rotatable shelf assembly 1 at a second speed, faster than the first. In other embodiments, the speed of rotation may be controlled recording the time that elapses between two consecutive input patterns of the same type, or in other words, two patterns that indicate that control circuitry 72 should perform the same function, like two consecutive patterns that indicate that control circuitry 72 should cause clockwise rotation. For example, if three consecutive inputs are received, forming a timed pattern, and then three more consecutive inputs are received, forming the same pattern, with 1 second elapsing there between, this may signal control circuitry 72 to cause the rotation of a rotatable shelf assembly 1 at a first speed. However, if three consecutive inputs are received, forming a pattern, and then three more consecutive inputs are received, forming the same pattern, with 0.5 seconds elapsing there between, this may signal control circuitry 72 to cause the rotation of a rotatable shelf assembly 1 at a second speed, faster than the first speed. The control circuitry 72 records the time differences between inputs of pattern one and pattern two. After this, 72 calculates by the ratio of the average time differences of pattern 1 and pattern 2 and enables the new voltage value for 53 based on that ratio. In yet other embodiments, control circuitry 72 may be configured to accelerate the rotation of a rotatable shelf assembly with each consecutive similar pattern of inputs that is received. For example, if a pattern of three consecutive inputs is received followed by a second pattern of three consecutive inputs, where the two patterns are the same, control circuitry 72 may cause the rotation of a rotatable shelf assembly 1 to accelerate. If a third pattern of the same type is then received, control circuitry 72 may then cause the rotation to accelerate yet again. In this way a user may cause the rotation speed to increase by repeating the same pattern again. In some embodiments, repeating the same pattern, i.e., a pattern of consecutive inputs, but in the opposite direction, may signal control circuitry 72 to decelerate the rotation speed. In some embodiments, control circuitry 72 may be configured to allow maximum rotation speed, beyond which it will not increase rotation speed.

Referring now to FIG. 9G, in some embodiments, a slide switch may be included on refrigerator 18 to allow a user to select from among various options that will determine how the control circuitry 72 causes the rotation of turntables 2. The slide switch may comprise a three-position switch which allows the user to select between controlling the rotation of turntables 2 with hand motions and sensors located on the side portions of interior walls 16, controlling the rotation with only hand gestures, or disabling rotation of turntables 2. If a user selects to control the rotation of turntables 2 with hand motions and sensors, as indicated when the slide switch is in the "On" position in FIG. 9G, the control circuitry will respond to the various input patterns described above. In FIG. 9G, "Inc Run" represents a pattern of inputs where a first input is received from a first sensor, followed by a second input from a second sensor immediately to the right of the first sensors, followed by a third input from a third sensor immediately to the right of the second sensor, all within a specified time limit. "Dec Run" represents the opposite pattern, where a first input is received from a first sensor, followed by a second input from a second sensor immediately to the left of the first sensors, followed by a third input from a third sensor immediately to the left of the second sensor, all within a specified time limit. "Random" indicates that a pattern of inputs is received from non-adjacent sensors or For example, if control circuitry 72 receives a first input from a first sensor followed by a second input from a second sensor immediately adjacent to the first sensor, within a specified time limit, and then receives no additional input within a second specified time limit, from the time the second input was received, this pattern may signal the control circuitry stop the rotatable shelf assembly from rotating. FIG. 9G, further illustrates an embodiment where touchless sensors located on right and left side portions of interior wall 16 are further used to control the rotation. "L On" in the figure, represents a scenario where an input is received from the left sensor, and "R On" indicates a scenario where an input is received from the right sensor. FIG. 9G thus presents a flow chart of the potential interaction of the various sensors that may be available in one embodiment of the invention.

Referring now to FIGS. 9E and 9F, flow charts representing how possible door positions, switch positions, and sensor inputs may be configured to cause rotation of turntables 2 are shown. As seen in FIG. 9E, when door 39 is in a closed position, turntable 2 rotation may or may not occur based upon which option a user has selected with the slide switch and whether or not the refrigerator's compressor 63 is running In certain configurations, control circuitry 72 may be configured to cause rotation of turntable 2 when compressor 63 is running FIG. 9F, illustrates possible automation results of some embodiments when the refrigerator's door 39 is in an open position. As seen in FIG. 9F, rotation may occur dependent on the selection of the slide switch, inputs received from the sensors, i.e., the "infrared beams" in the figure, and inputs received from touchless sensors 70 located on the right and left side portions of interior wall 16. The refrigerator may also include a sensor array; the sensor array may be configured for a mode which will cause the motor to stop with or without control circuitry 72 if any beam is broken and any input is received. In some embodiments, when a hand approaches rotatable shelf assembly 1, the when the sensor array detects that a single beam has been broken, then the refrigerator will cause the rotating shelf to stop rotating. Additionally, various hand gestures and swiping gestures may be used to control the rotation of the rotating shelf assembly via 1 via control circuitry 72.

Figure 10A:
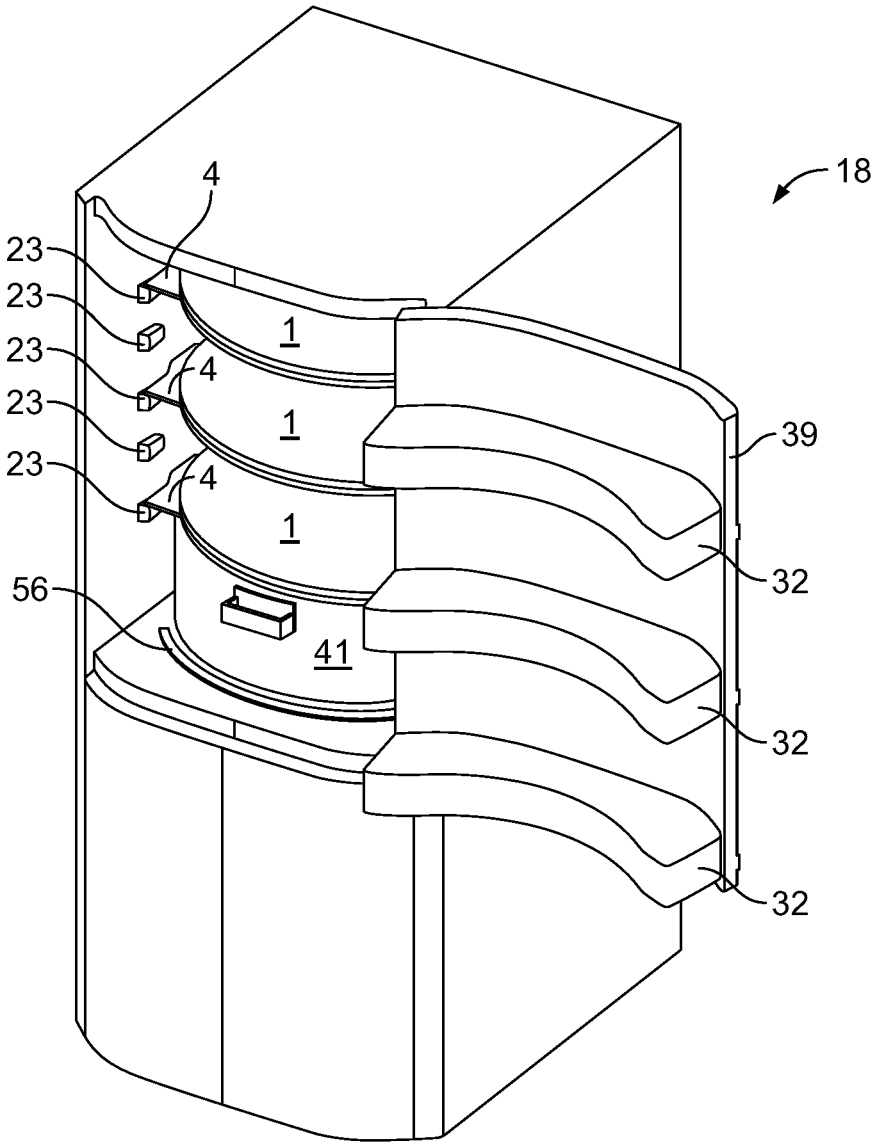
FIG. 10A is a perspective view of a refrigerator comprising some embodiments of the invention with the refrigerator door in an open position.
Figure 10B:
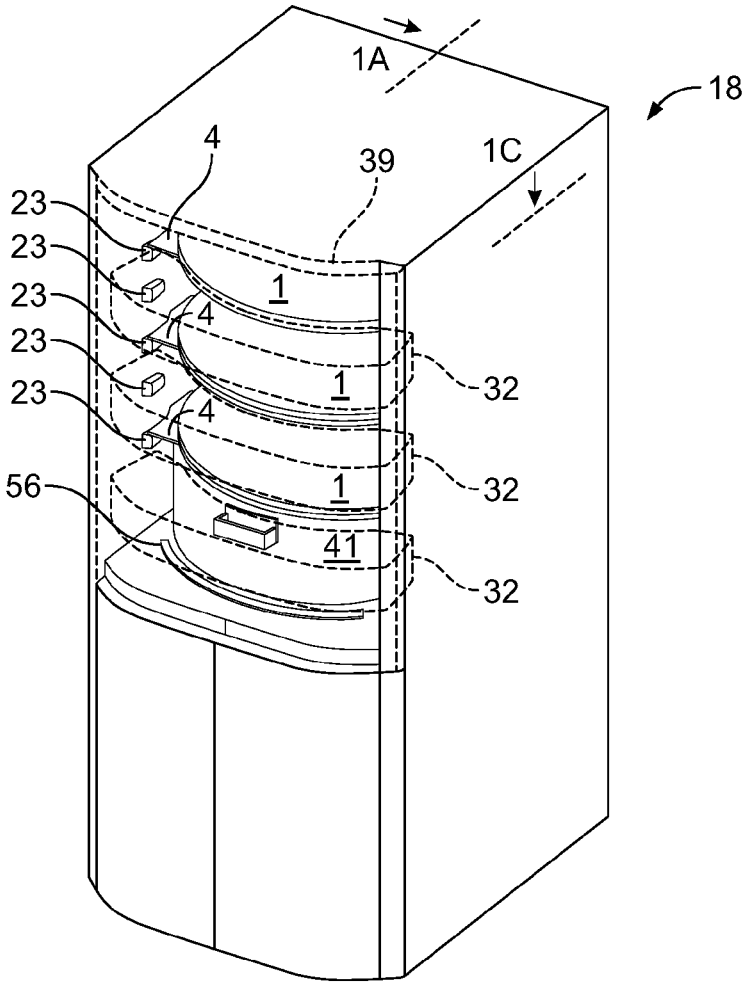
FIG. 10B is a perspective view of the refrigerator of FIG. 10A with the refrigerator door fully closed and the refrigerator door and refrigerator door shelves shown with broken lines.

Referring now to FIG. 10A, an embodiment of the invention is shown, comprising refrigerator 18 with three of rotatable shelf assembly 1 disposed therein. A rotatable drawer assembly 41 is also included. Door 39 comprises three door shelves 32 and is shown in an open position. FIG. 10B illustrates the embodiment shown in FIG. 10A but with door 39 in a closed position. Door 39 and door shelves 32, however, are depicted in dashed lines so that the interior of refrigerator 18 may still be seen.

Figure 11:
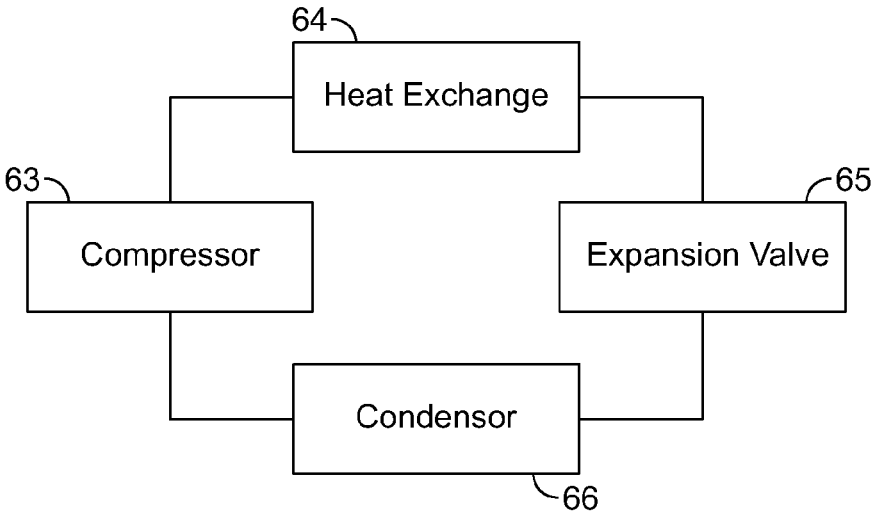
FIG. 11 is a schematic view of an embodiment of the components necessary to produce refrigerated air for use in a refrigerator comprising some embodiments of the invention.

FIG. 11 illustrates, in schematic form, the major components necessary to provide refrigerated air for refrigerator 18. Refrigerator 18 may comprise a closed loop system including a compressor 63, a heat exchange 64, an expansion valve 65, and a condenser 68, with refrigerant running through the system. Compressor 63 may pressurize the refrigerant causing it to increase in temperature and turn into a gas. The pressurized refrigerant gas then flows to the heat exchange 64 where some of the heat may dissipate returning the refrigerant to liquid form. The high-pressure liquid refrigerant than flows through expansion valve 65 into condenser 66, causing the gas to immediately vaporize and absorb the heat from within the refrigeration space 29, thus cooling the refrigerator 18. The refrigerant may then be returned to the compressor, and the cycle repeats. Heat exchange 64 and condenser 68 may comprise a series of coils.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A refrigerator comprising:

at least one rotatable shelf disposed within an interior space of the refrigerator, the at least one rotatable shelf comprising:

an inner zone being defined by a cylinder wherein a central axis of the cylinder is concentrically disposed with a center of a top surface of the at least one rotatable shelf, wherein the cylinder extends from the top surface of the at least one rotatable shelf to a bottom surface of the at least one rotatable shelf, wherein a top surface of the cylinder is defined by a circle with a 3-inch radius, the circle being concentrically disposed with the center of the top surface of the at least one rotatable shelf; and, an outer zone consisting of any portion of the at least one rotatable shelf which is not disposed within the inner zone; and, at least one motor mechanically coupled to the outer zone of the at least one rotatable shelf, the at least one motor being configured to rotate the at least one rotatable shelf about the central axis of the cylinder; and, a door, the door comprising:

an outer surface;

an inner surface; and at least one door shelf extending from the inner surface, wherein a distal edge portion of the at least one door shelf is configured to extend into an interior space of the refrigerator, wherein the at least one door shelf further comprises a substantially circular central section-defined by a first arc which is a fractional part of a circumference that is defined by a radius with a beginning point which is concentric with a center of the at least one rotatable shelf; and, a distal end section, wherein a portion of the distal end section is a curved end section defined by a second arc that is a fractional part of a circumference that is defined by a radius with a beginning point which is concentric with a door hinge point that is positioned nearer to the distal end section than any other door hinge point of the door, wherein a door hinge that is concentric with the door hinge point is configured to allow for the door to be opened when the door is rotated around the door hinge point.

2. The refrigerator of claim 1 wherein the at least one door shelf further comprises:

an inflection point, wherein the inflection point is adjacent to both the substantially circular central section and the distal end section, and wherein the inflection point is defined by the point at which the first arc is tangent to the second arc.

3. The refrigerator of claim 2 wherein the at least one door shelf is further configured to allow for a clearance between the distal end section and the at least one rotatable shelf when the door is being opened.

4. The refrigerator of claim 3 wherein the at least one door shelf is further configured to accommodate a standard one-gallon milk jug in at least one end of the at least one door shelf and is further configured to accommodate a carton for at least one-dozen eggs in which the carton is located substantially in a central portion of the at least one door shelf.

5. The refrigerator of claim 2 wherein the distance between the first arc and the center of the at least one rotatable shelf is equal to the radius of the at least one rotatable shelf.

6. The refrigerator of claim 2 wherein the distance between the first arc and the center of the at least one rotatable shelf is greater than the radius of the at least one rotatable shelf.

7. The refrigerator of claim 2 wherein the second arc is a fractional part of less than $1/5^{th}$ of the circumference that is defined by the radius with a beginning point which is concentric with the door hinge point that is positioned nearer to the distal end section than any other door hinge point of the door.

8. The refrigerator of claim 1, wherein the at least one rotatable shelf further comprises a plurality of rotatable shelves disposed within the interior space of the refrigerator, wherein the plurality of rotatable shelves that are not mechanically coupled to the at least one motor of claim 1 are individually and mechanically coupled to at least one motor, wherein the at least one motor of claim 1 and the at least one motor are configured to be independently operable and are further configured to actuate an independent rotation of at least one but not all of the plurality of rotatable shelves.

9. The refrigerator of claim 1, wherein the at least one motor is configured to automatically rotate the at least one rotatable shelf when a compressor of the refrigerator is operated.

10. The refrigerator of claim 1 further comprising a support bracket detachably coupled to the at least one rotatable shelf, the support bracket comprising:

an inner surface;

an upper surface;

a lower surface; and an outer edge portion configured to physically engage at least one inner wall of the refrigerator, the outer edge portion being further configured to orient the upper surface of the support bracket in a substantially horizontally direction within the refrigerator, and the lower surface of the support bracket being detachably engaged with at least three bearings of a bearing ring.

11. The refrigerator of claim 10 wherein the support bracket further comprises an annular ring, the annular ring comprising:

a lower surface;

an inner surface; and, an outer surface, wherein the annular ring further comprises at least one annular flange extending from the lower surface of the annular ring, the at least one annular flange further comprising at least three bearings disposed within the at least one annular flange, wherein the at least one annular flange and the inner surface of the support bracket are configured to allow the at least three bearings disposed within the at least one annular flange to roll on the inner surface of the support bracket.

12. The refrigerator of claim 10 wherein the support bracket further comprises at least one surface configured to be rested upon at least one cantilever support extending from an inner wall of the refrigerator.

13. A refrigerator comprising:

at least one rotatable shelf disposed within an interior space of the refrigerator, the at least one rotatable shelf comprising:

an inner zone being defined by a cylinder wherein a central axis of the cylinder is concentrically disposed with a center of a top surface of the at least one rotatable shelf, wherein the cylinder extends from the top surface of the at least one rotatable shelf to a bottom surface of the at least one rotatable shelf, wherein a top surface of the cylinder is defined by a circle with a 3-inch radius, the circle being concentrically disposed with the center of the top surface of the at least one rotatable shelf; and an outer zone consisting of any portion of the at least one rotatable shelf which is not disposed within the inner zone;

at least one motor mechanically coupled to the outer zone of the at least one rotatable shelf, the at least one motor being configured to rotate the at least one rotatable shelf about the central axis of the cylinder; and an array comprising two or more proximity sensors, the array being configured for detection of the spatial relationship between an object and the two or more proximity sensors; and at least one electronic control unit communicatively coupled to a first proximity sensor selected from the two or more proximity sensors and to a second proximity sensor selected from the two or more proximity sensors, the at least one electronic control unit being configured to first determine when the second proximity sensor has detected an object after the first proximity sensor has detected the object and then command the motor to rotate such that the rotatable shelf rotates.

14. The refrigerator of claim 13 wherein the object is the shape and size of a hand, wherein the length of the object is at least 2 inches in length and less than 15 inches in length.

15. The refrigerator of claim 13 wherein the at least one rotatable shelf further comprises a plurality of rotatable shelves disposed within the interior space of the refrigerator, wherein the plurality of rotatable shelves that are not mechanically coupled to the at least one motor of claim 10 are individually and mechanically coupled to at least one motor, wherein the at least one motor of claim 10 and the at least one motor of claim 12 are configured to be independently operable and are further configured to actuate an independent rotation of at least one but not all of the plurality of rotatable shelves.

16. The refrigerator of claim 13 wherein the refrigerator further comprises at least one switch coupled to the at least one motor, wherein the at least one switch is configured to control the at least one motor and to receive at least one input.

17. The refrigerator of claim 13 further comprising a door, the door comprising:

an outer surface;

an inner surface; and at least one door shelf configured to extend into the interior space of the refrigerator, wherein the at least one door shelf further comprises a substantially circular central section defined by a first arc which is a fractional part of a circumference that is defined by a radius with a beginning point which is concentric with the center of the top surface of the at least one rotatable shelf; and, a distal end section, wherein a portion of the distal end section is a curved end section defined by a second arc which is a fractional part of a circumference that is defined by a radius with a beginning point which is concentric with the door hinge point that is positioned nearer to the distal end section than any other door hinge point of the door; wherein the door hinge is configured to allow for the door to be opened when the door is rotated around the door hinge point.

18. The refrigerator of claim 17 wherein a clearance exists between the substantially circular central section of the at least one door shelf and the at least one rotatable shelf when the door is closed.

19. The refrigerator of claim 17 wherein the door shelf further comprises an inflection point, wherein the inflection point is adjacent to both the substantially circular central section and the distal end section, and wherein the inflection point is located within 3-inches of the point at which the first arc is tangent to the second arc when the door is in a fully-closed position.

20. The refrigerator of claim 13, wherein the at least one motor is configured to automatically rotate the at least one rotatable shelf when a compressor of the refrigerator is operated.

* * * * *